US006472138B1

(12) United States Patent
Yamane

(10) Patent No.: US 6,472,138 B1
(45) Date of Patent: Oct. 29, 2002

(54) BLACK AND WHITE PHOTOTHERMOGRAPHIC MATERIAL AND METHOD FOR FABRICATING THEREOF

(75) Inventor: Katsutoshi Yamane, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/671,242

(22) Filed: Sep. 28, 2000

(30) Foreign Application Priority Data

Sep. 28, 1999 (JP) ..... 11-273670

(51) Int. Cl.[7] ..... G03C 1/498; G03C 1/34

(52) U.S. Cl. ..... 430/619; 430/611; 430/617; 430/620

(58) Field of Search ..... 430/619, 611, 430/617, 620

(56) References Cited

U.S. PATENT DOCUMENTS 5,922,529 A * 7/1999 Tsuzuki et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

A black and white photothermographic material for laser exposure affording a large covering power and thus affording a high Dmax, and capable of suppressing desensitization in the course of the storage is provided. Such black and white photothermographic material contains on one side of a support a reducing agent for reducing silver ion, a binder, a non-photosensitive fatty acid silver salt and a photosensitive silver halide, wherein the photosensitive silver halide forms grains with an average grain size of 10 nm to 50 nm prepared independently from the non-photosensitive fatty acid silver salt; and wherein a compound expressed by the formula (1) below is further contained:

$$[(Z)_mL]_nASM^1 \qquad \text{formula (1)}$$

[where, in the formula (1),

Z represents $—SO_3M^2$, $—COOR^1$, —OH or $—NHR^2$; in which $M^2$ being a hydrogen atom or an alkali metal atom, $R^1$ being a hydrogen atom, an alkali metal atom or an alkyl group with having 1 to 6 carbon atoms, $R^2$ being a hydrogen atom, an alkyl group having 1 to 6 carbon atoms, $—COR^4$, $—COOR^4$ or $—SO_2R^4$, in which $R^4$ being a hydrogen atom, an aliphatic group or an aromatic group;

m is an integer not less than 1, and for the case of $m \geqq 2$, the groups Z in a number of m may be same or different with each other;

L represents a single bond or a linkage group;

n is an integer not less than 1, and for the case of $n \geqq 2$, the groups $(Z)_mL$ in a number of n may be same or different with each other;

A is a heterocyclic group which may be substituted; and $M^1$ is a hydrogen atom or an alkali metal atom.]

14 Claims, No Drawings

BLACK AND WHITE PHOTOTHERMOGRAPHIC MATERIAL AND METHOD FOR FABRICATING THEREOF

BACKGROUND OF THE INVENTION

1. Field of the Invention

The present invention relates to a photothermographic material and a method for fabricating thereof.

2. Description of Related Art

A strong need for reducing the volume of the waste of processsing solution has arisen in recent medical diagnosis field from viewpoints of environmental preservation and space saving. Thus a technology related to a photothermographic material for medical diagnosis and photographic purposes has been desired, in which the material is expected to allow efficient light exposure with a laser image setter or laser imager, and to provide a black image with a high resolution and sharpness. Such photothermographic material can provide the user with a more simple and environment-conscious image producing system using no solution-base process chemical.

While a similar need has been occurring in the field of general image forming materials, images used in the medical diagnosis field specifically require a high image quality such as excellent sharpness and graininess for fine depiction, and prefer a blue-black tone for facilitating diagnoses. Although various hard copy system using pigment or dye, exemplified as an inkjet printer and electronic photograph system, are prevailing as a general image forming system, none of which is satisfactory as an output system for medical images.

Other type of photothermographic system using an organic silver salt is known, for example, in U.S. Pat. Nos. 3,152,904 and 3,457,075 and "Thermally Processed Silver Systems" by D. Klosterboer, Imaging Processes and Materials, Neblette's 8th ed., edited by J. Sturge, V. Walworth and A. Shepp, Chapter 9, p. 279, (1989). In particular, the photothermographic material generally has a photosensitive layer comprising a catalytic amount of a photocatalyst (e.g., silver halide), a reducing agent, a reducible silver salt (e.g., organic silver salt), and an optional toner for controlling color tone of silver image, all of which being dispersed in a binder matrix. The photothermographic material produces a black silver image when heated, after light exposure, to a high temperature (e.g., 80.C. or above) through redox reaction of the silver halide or reducible silver salt with the reducing agent. Since the redox reaction is promoted by a catalytic action of silver halide composing a latent image, which is produced by the light exposure, that the blacked silver image is formed in the exposed area. Such heat-assisted image producing system is disclosed in numbers of literatures typified by U.S. Pat. No. 2,910,377 and JP-B-43-4924 (the code "JP-B-" as used in this specification means an "examined Japanese patent publication"), and recently Fuji Medical Dry Imager FM-DPL was launched as a medical image producing system using such photothermographic material.

Such black and white photothermographic material utilizing the non-photosensitive fatty acid silver salt and the photosensitive silver halide can achieve a higher maximum optical density (Dmax) by employing smaller silver halide grains to enhance the covering power. A problem, however, resides in that the adsorption of a sensitizing dye onto the silver halide grains becomes weaker as the silver halide grains become smaller, which is causative of increased desensitization during a long-term storage. Solving means therefor is thus eagerly desired.

SUMMARY OF THE INVENTION

It is therefore an object of the present invention to solve the foregoing problem in the prior art.

That is, an object of the present invention is to provide a black and white photothermographic material for laser exposure affording a large covering power and thus affording a high Dmax, and capable of suppressing desensitization in the course of the storage.

The present inventor found out, after extensive studies, that an excellent photothermographic material exhibiting desired function can be fabricated by using a photosensitive silver halide grains having an average grain size of 10 nm to 50 nm, and also by using a compound expressed by the formula (1) as defined in this specification, which led the inventor to propose the present invention.

That is, the present invention provides a black and white photothermographic material containing on one side of a support a reducing agent for reducing silver ion, a binder, a non-photosensitive fatty acid silver salt and a photosensitive silver halide, wherein such photosensitive silver halide forms grains with an average grain size of 10 nm to 50 nm prepared independently from such non-photosensitive fatty acid silver salt; and wherein a compound expressed by the formula (1) below is further contained:

$$[(Z)_mL]_nASM^1 \qquad \text{formula (1)}$$

[where, in the formula (1),

Z represents $—SO_3M^2$, $—COOR^1$, —OH or $—NHR^2$; in which $M^2$ being a hydrogen atom or an alkali metal atom, $R^1$ being a hydrogen atom, an alkali metal atom or an alkyl group having 1 to 6 carbon atoms, $R^2$ being a hydrogen atom, an alkyl group having 1 to 6 carbon atoms, $—COR^4$, $—COOR^4$ or $—SO_2R^4$, in which $R^4$ being a hydrogen atom, an aliphatic group or an aromatic group;

m is an integer not less than 1, and for the case of $m \geqq 2$, the groups Z in a number of m may be same or different with each other;

L represents a single bond or a linkage group;

n is an integer not less than 1, and for the case of $n \geqq 2$, the groups $(Z)_mL$ in a number of n may be same or different with each other;

A is a heterocyclic group which may be substituted; and $M^1$ is a hydrogen atom or an alkali metal atom.]

The compound expressed by the formula (1) is preferably contained as being adsorbed on the non-photosensitive fatty acid silver salt.

The average grain size of the photosensitive silver halide is preferably 10 nm to 45 nm, and more preferably 10 nm to 40 nm.

Another aspect of the present invention is to provide a method for fabricating a black and white photothermographic material containing on one side of a support a reducing agent for reducing silver ion, a binder, a non-photosensitive fatty acid silver salt and a photosensitive silver halide, comprising:

a step for preliminarily making a compound expressed by the formula (1) below adsorb to grains of the non-photosensitive fatty acid silver salt:

$$[(Z)_mL]_nASM^1 \qquad \text{formula (1)}$$

[where, in the formula (1), Z represents $—SO_3M^2$, $—COOR^1$, —OH or $—NHR^2$; in which $M^2$ being a hydrogen atom or an alkali metal atom, $R^1$ being a hydrogen atom, an alkali metal atom or an alkyl group having 1 to 6 carbon atoms, $R^2$ being a hydrogen atom, an alkyl group having 1 to 6 carbon atoms, —$COR^4$, —$COOR^4$ or —$SO_2R^4$, in which $R^4$ being a hydrogen atom, an aliphatic group or an aromatic group;

m is an integer not less than 1, and for the case of m≧2, the groups Z in a number of m may be same or different with each other;

L represents a single bond or a linkage group;

n is an integer not less than 1, and for the case of n≧2, the groups $(Z)_mL$ in a number of n may be same or different with each other;

A is a heterocyclic group which maybe substituted; and $M^1$ is a hydrogen atom or an alkali metal atom.];

a step for preparing the photosensitive silver halide grains having an average grain size of 10 nm to 50 nm; and a step for mixing the non-photosensitive fatty acid silver salt grains having the compound expressed by the formula (1) adsorbed thereon with the photosensitive silver halide grains.

The present invention is the first to provide a photothermographic material high in Dmax and at the same time less in sensitivity degradation (desensitization) during the storage.

DETAILED DESCRIPTION OF THE INVENTION

Mode of implementation and embodiment of the black and white photothermographic material of the present invention will be detailed hereinafter.

The photothermographic material of the present invention contains on one side of a support a reducing agent for reducing silver ion, a binder, a non-photosensitive fatty acid silver salt and a photosensitive silver halide, such photosensitive silver halide forms grains with an average grain size of 10 nm to 50 nm, and a compound expressed by the formula (1) below is further contained. Now the expression of range of values with a term "to" in this specification is defined as both end values placed before and after "to" being inclusive.

In the present invention, the compound expressed by the formula (1) is used so as to exhibit desensitization effect. One specific embodiment of the use allowing the exhibition of the desensitization effect relates to such that making the compound expressed by the formula (1) adsorb on the non-photosensitive fatty acid silver salt grains.

For a full exhibition of the present invention, it is necessary to prepare the non-photosensitive fatty acid silver salt grains and the photosensitive silver halide grains separately. By such separate preparation of the non-photosensitive fatty acid silver salt grains and the photosensitive silver halide grains, specific compounds necessary for the individual grains can selectively be adsorbed thereon. The order of the preparation of the non-photosensitive fatty acid silver salt grains and the photosensitive silver halide grains is not limitative, so that it is allowable to prepare either one precedently and then prepare the other successively; or both of them may separately be prepared at the same time.

The silver halide grains generally have a spectral sensitizing dye adsorbed thereon since the grains require spectral sensitization. The sensitizing dye may be adsorbed also on the non-photosensitive fatty acid silver salt grains. The present inventor found out that the reduction in the sensitivity (desensitization) of the photosensitive material during the storage after being fabricated by the coating is ascribable to a gradual migration of the sensitizing dye toward the fatty acid silver salt grains, and that such migration can significantly be improved by preliminarily making the compound expressed by the formula (1) adsorb on the non-photosensitive fatty acid silver salt grains, mixing such grains with the silver halide grains, and completing the coating and drying in a short time.

In particular for the case that the silver halide grains have a small grain size, it is difficult to obtain the silver halide grains with a well-ordered crystal habit, and thus the (100) plane advantageous in adsorbing the sensitizing dye is not likely to appear, which significantly weakens the adsorption of the sensitizing dye and enhances the migration thereof to the fatty acid silver salt grains. In such case, addition of the compound expressed by the formula (1) will provide a desirable effect.

The present invention will be detailed hereinafter.

The photothermographic material of the present invention necessarily contains the water-soluble mercapto compounds expressed by the formula (1) below:

$$[(Z)_mL]_nASM^1 \qquad \text{formula (1)}$$

[where, in the formula (1),

Z represents —$SO_3M^2$, —$COOR^1$, —OH or —$NHR^2$; in which $M^2$ being a hydrogen atom or an alkali metal atom, $R^1$ being a hydrogen atom, an alkali metal atom or an alkyl group having 1 to 6 carbon atoms, $R^2$ being a hydrogen atom, an alkyl group having 1 to 6 carbon atoms, —$COR^4$, —$COOR^4$ or —$SO_2R^4$, in which $R^4$ being a hydrogen atom, an aliphatic group or an aromatic group;

m is an integer not less than 1, and for the case of m≧2, the groups Z in a number of m may be same or different with each other;

L represents a single bond or a linkage group;

n is an integer not less than 1, and for the case of n≧2, the groups $(Z)_mL$ in a number of n may be same or different with each other;

A is a heterocyclic group which maybe substituted; and $M^1$ is a hydrogen atom or an alkali metal atom.]

In this specification, the alkali metal atoms expressed by $M^1$, $M^2$ or $R^2$ include Li, Na and K; among which Na is particularly preferable.

In this specification, the alkyl group having 1 to 6 carbon atoms expressed by $R^1$ or $R^2$ include such that having a straight-chained, branched or cyclic structure or having a combined structure thereof, and examples of which include methyl group, ethyl group, n-propyl group, isopropyl group, n-butyl group, isobutyl group, sec-butyl group, tert-butyl group, pentyl group and hexyl group.

In this specification, the fatty acid group expressed by $R^4$ is exemplified as a saturated or unsaturated hydrocarbon group having 1 to 6 carbon atoms, and preferably as an alkyl group having 1 to 6 carbon atoms.

In this specification, the aromatic group expressed by $R^4$ is exemplified as an aryl group having 6 to 20 carbon atoms, and specific examples of which include phenyl group, naphthyl group and anthryl group.

In this specification, m is an integer not less than 1, and for the case of m≧2, the groups "Z" in a number of maybe same or different with each other. While the upper limit of m is not specifically limited, m is preferably 1, 2 or 3, and more preferably 1 or 2.

In this specification, L represents a single bond or a linkage group. When "L" represents a single bond, the substituent "Z" directly binds to the heterocyclic group "A". For the case that "L" represents a linkage group, specific examples of which include alkylene group having 1–6 carbon atoms, arylene group (e.g., phenylene group), —O—, —S—, —NR— (where in the formula, "R" represents a fatty acid group or aromatic group, and examples of these groups are the same as those described for $R^4$), and combinations thereof. Examples of the foregoing alkylene group having 1 to 6 carbon atoms, or an alkylene portion in a thioalkylene group or oxyalkylene group include methylene group, ethylene group, propylene group, butylene group, pentylene group and hexylene group, which may be of straight or branched structure. There is no specific limitation on the positions on the linkage group to which the substituent "Z" and heterocyclic group "A" can bind. When the linkage group includes —S— or —O—, a heterocyclic group "A" preferably binds to the —S— or —O— of such linkage group.

Examples of the linkage group other than the foregoing alkylene group and arylene group include $—SCH_2—$, $—SCH_2CH_2—$, $—SCH(n—C_4H_9)—$, $—SCH_2CH_2N(CH_2)_2—$, $—SCH(n—C_3H_7)—$ and $—OCH_2—$.

In this specification, n is an integer not less than 1, and for the case of $n \geqq 2$, the groups "$(Z)_mL$" in a number of n may be same or different with each other. While the upper limit of n is not specifically limited, n is preferably 1, 2 or 3, and more preferably 1 or 2.

In this specification, "A" represents a heterocyclic group which maybe substituted. The heterocyclic group is typically an aromatic group or condensed aromatic group containing at least one hetero atom selected from the nitrogen, sulfur, oxygen, selenium and tellurium. Specific examples of the heterocycle include benzoimida-zole, naphthimidazole, benzothiazole, naphththiazole, benzoxazole, naphthoxazole, benzoselenazole, benzotellurazole, imidazole, imidazoline, oxazole, oxadiazole, pyrazole, triazole, thiadiazole, tetrazole, triazine, pyrimidine, pyridazine, pyrazine, pyridine, purine, quinoline and quinazolinone.

These heterocycles may have any substituent selected from the group consisting of a halogen atom (e.g., fluorine atom, chlorine atom, bromine atom or iodine atom), hydroxyl group, amino group, carboxyl group, alkyl group (such that having 1 or more carbon atoms, and preferably 1 to 4 carbon atoms), alkoxy group (such that having 1 or more carbon atoms, and preferably 1 to 4 carbon atoms), and aryl group (which may be substituted).

Preferable examples of the compound expressed by the formula (1) are listed below, while those available in the present invention being not limited thereto.

I-(1)

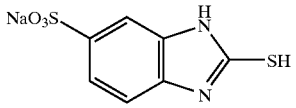

I-(2)

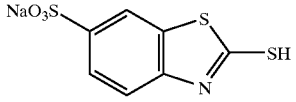

I-(3)

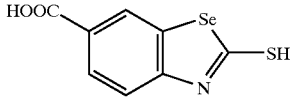

-continued

I-(4)

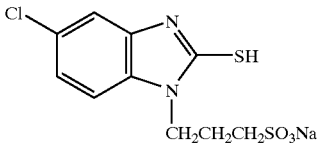

I-(5)

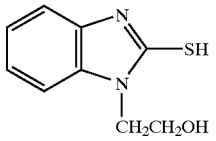

I-(6)

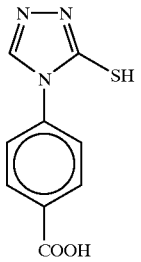

I-(7)

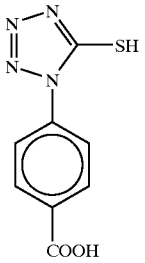

I-(8)

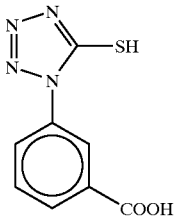

I-(9)

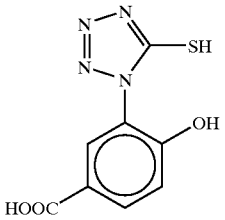

-continued
I-(10)
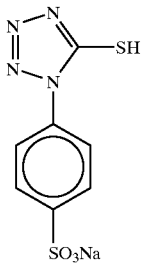
I-(11)
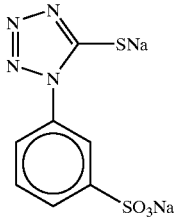
I-(12)
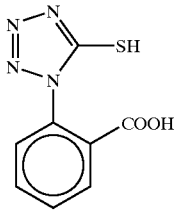
I-(13)
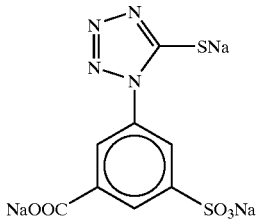
I-(14)
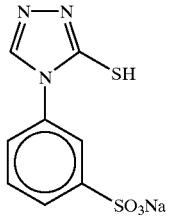
I-(15)
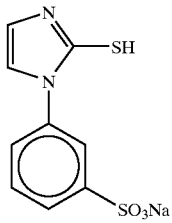
I-(16)
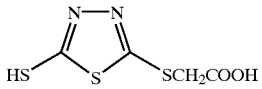
I-(17)
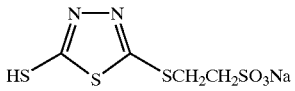
-continued
I-(18)
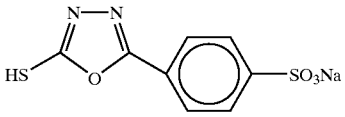
I-(19)
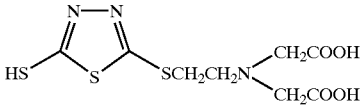
I-(20)
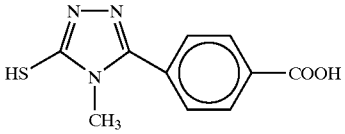
I-(21)
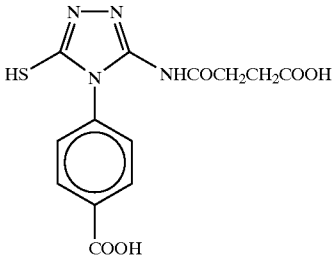
I-(22)
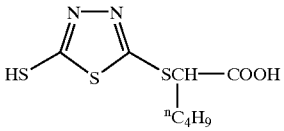
I-(23)
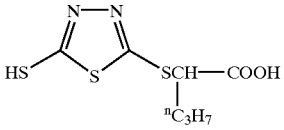
I-(24)
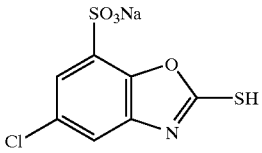
I-(25)
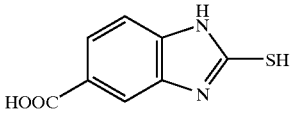
I-(26)
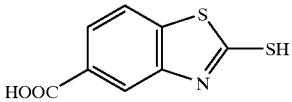
I-(27)
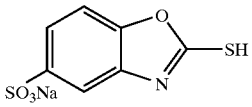
I-(28)
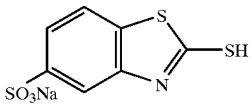

-continued

I-(29)

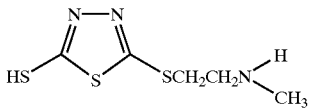

The compound expressed by the formula (1) is efficiently adsorbed on the fatty acid silver salt grains, and is less migratory toward the silver halide grains even after the fatty acid silver salt grains are mixed therewith, so that the compound can fully exhibit function as an anti-desensitization agent. In particular, the compound having —$SO_3M$ for "Z" in the formula (1) is preferably used.

When the water-soluble mercapto compound of the formula (1) is added, it is preferably adsorbed on the non-photosensitive fatty acid silver grains before being mixed with the silver halide grains. Such way of addition allows the compound of the formula (1) to excellently exhibit effects as an anti-desensitization agent. The preferable amount of addition resides within a range from $1\times10^{-5}$ to $1\times10^{-2}$ mol per mole of fatty acid silver salt, and more preferably $1\times10^{-4}$ to $5\times10^{-3}$ mol.

The black and white photothermographic material of the present invention uses the non-photosensitive fatty acid silver salt. The non-photosensitive fatty acid silver salt is a silver salt of a fatty acid, which is relatively stable against light exposure but can produce a silver image when heated at 80. C. or higher in the presence of a light-exposed photocatalyst (e.g., latent image produced with the photosensitive silver halide) and a reducing agent. Among various silver salts of fatty acids, particularly preferable are those of long-chained aliphatic carboxylic having 10 to 30 carbon atoms, and more preferably 15 to 28 carbon atoms. Examples thereof include silver behenate, silver arachidinate, silver stearate, silver oleate, silver laurate, silver caproate, silver myristate, silver palmitate and mixtures thereof.

While there is no particular limitation on the grain shape of the fatty acid silver salt grains available in the present invention, scaly fatty acid silver salt grains are preferable. In the present invention, the scaly fatty acid silver salt grain is now defined as follows. The grain of the fatty acid silver salt is microscopically observed and the shape thereof is approximated as a rectangular parallelepiped. Edges of the rectangular parallelepiped are denoted as "a", "b" and "c" in the order from the shortest length ("c" may be equal to "b"), then "x" is obtained from the equation below:

$$X=b/a$$

Such value "X" is calculated for approx. 200 grains and an average "x(average)" thereof is derived, in which those satisfying a relation of x(average)≧1.5 are defined as of scaly shape, preferably satisfying 30≧x(average)≧1.5, and more preferably 20≧x(average)≧2.0. For reference, acicular form is defined for those satisfying a relation of 1≧x (average)<1.5.

As for a scaly grain, "a" can be assumed as a thickness of a tabular grain having a major plane surrounded by edges "b" and "c". The average of "a" is preferably 0.01 to 0.23 μm, and more preferably 0.1 to 0.20 μm. An average of "c/b" is preferably 1 to 6, more preferably 1.05 to 4, still more preferably 1.1 to 3, and most preferably 1.1 to 2.

Grain size distribution of the fatty acid silver salt grains is preferably of monodisperse. The term "monodisperse" as used herein means that the percentage of the value obtained by dividing the standard deviation of the length of the short axis and long axis respectively by the length of the short axis and long axis is preferably 100% or less, more preferably 80% or less, still more preferably 50% or less. Shape of the fatty acid silver salt grains can be measured based on an image of the fatty acid silver salt dispersion observed through a transmission electron microscope. Another method for determining the monodispersibility is such that obtaining the standard deviation of volume weighted mean diameter of the fatty acid silver salt grains. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the fatty acid silver salt grains dispersed in a solution; deriving an autocorrelation function with respect to the time-dependent fluctuation in the scattered light intensity; and thereby obtaining grain size (volume weighted mean diameter).

The fatty acid silver salt for use in the present invention can be prepared by reacting a solution or suspension of alkali metal salt (exemplified as sodium salt, potassium salt and lithium salt) of the above-described fatty acid with silver nitrate. The alkali metal salt of the fatty acid is obtained by alkali treatment of the above-described fatty acid. The fatty acid silver salt can be prepared in an arbitrary proper vessel in a batch or continuous manner. Stirring in the reaction vessel may be effected with an arbitrary stirring method according to target properties of the grains. Preferable methods applicable for preparing the fatty acid silver salt include such that adding abruptly or gradually an aqueous silver nitrate solution into a reaction vessel containing a solution or suspension of the alkali metal salt of the fatty acid; such that adding abruptly or gradually a previously prepared solution or suspension of the alkali metal salt of the fatty acid into a reaction vessel containing an aqueous silver nitrate solution; and such that pouring at a time into a reaction vessel an aqueous silver nitrate solution and a solution or suspension of the alkali metal salt of the fatty acid, both of which being previously prepared.

The aqueous silver nitrate solution, and solution or suspension of the alkali metal salt of the fatty acid may be used in an arbitrary concentration and may be added at an arbitrary rate of addition to control the grain size of the fatty acid silver salt grains to be prepared. The addition of the aqueous silver nitrate solution, or solution as well as suspension of the alkali metal salt of the fatty acid may be effected at a constant addition rate, or accelerated or decelerated addition rate according to an arbitrary time-related function. Either addition onto the surface of the solution or deep into the solution are allowable. When an aqueous silver nitrate solution and a solution or suspension of the alkali metal salt of the fatty salt, both being previously prepared, are poured at a time into a reaction vessel, either the aqueous silver nitrate solution, or the solution or suspension of the alkali metal salt of the fatty acid may precedently be poured, where the aqueous silver nitrate solution is preferably poured in a preceding manner. A degree of the precedence may preferably be 0 to 50 vol % of the total addition, and more preferably 0 to 25 vol %. It is also preferable as disclosed in JP-A-9-127643 (the code "JP-A" as used herein means an "unexamined published Japanese patent application"), to add the solution while controlling pH or silver potential of the reaction solution during the reaction.

The aqueous silver nitrate solution, or the solution or suspension of the alkali metal salt of the fatty acid to be added may have pH thereof adjusted according to target properties of the resultant grains. An arbitrary acid or alkali can be added for the pH control. Temperature of the content in the reaction vessel can arbitrarily be set according to the required characteristics, for example to control the grain size of the fatty acid silver salt, and the same will apply to the aqueous silver nitrate solution to be added, or the solution or suspension of the alkali metal salt of the fatty acid to be added. The solution or suspension of the alkali metal salt of the fatty acid is preferably kept by heating at 50° C. or above to ensure a proper fluidity thereof.

The fatty acid silver salt for use in the present invention is preferably prepared in the presence of a tertiary alcohol. The tertiary alcohol used in the present invention preferably has 15 or less total carbon atoms, and more preferably 10 or less total carbon atoms. A preferable example of such tertiary alcohol relates to t-butanol, while being not limited thereto. While the tertiary alcohol used in the present invention may be added at any timing during the preparation of the fatty acid silver salt, it is preferable to add the alcohol at the time of preparation of the alkali metal salt of the fatty acid and to use the alkali metal salt of the fatty acid in a dissolved state. The amount of addition of the tertiary alcohol may be set at an arbitrary ratio by weight within a range from 0.01 to 10 relative to water as a solvent used for preparing the fatty acid silver salt, and preferably from 0.03 to 1.

When the scaly fatty acid silver salt grains valuable in the present invention are produced by reacting an aqueous solution containing a water-soluble silver salt and an aqueous tertiary alcohol solution containing the alkali metal salt of the fatty acid (including a step for adding into a liquid in the reaction vessel an aqueous tertiary alcohol solution containing the alkali metal salt of the fatty acid), it is preferable to keep the temperature difference between the solution in the reaction vessel and the aqueous tertiary alcohol solution containing the alkali metal salt of the fatty acid within a range from 20 to 85° C.; the solution in the reaction vessel being preferably a pre-charged aqueous solution containing the water-soluble silver salt, or, for the case that the aqueous solution containing the water-soluble silver salt is added, rather than in precedence, at the same time with the aqueous tertiary alcohol solution containing the alkali metal salt of the fatty acid, being water or a mixed solvent of water and the tertiary alcohol, which may previously be contained in the vessel also for the case that the aqueous solution containing the water-soluble silver salt is previously poured.

Crystal form or the like of the fatty acid silver salt grains is preferably controlled by keeping such temperature difference during the addition of the aqueous tertiary alcohol solution containing the alkali metal salt of the fatty acid.

The water-soluble silver salt is preferably silver nitrate, and the concentration of the water-soluble silver salt in the aqueous solution is preferably 0.03 to 6.5 mol/l, more preferably 0.1 to 5 mol/l, and pH of the aqueous solution is preferably 2 to 6, more preferably pH 3.5 to 6.

A tertiary alcohol having 4 to 6 carbon atoms may be contained, content by volume of which being 70% or less relative to the total volume of the aqueous solution of the water-soluble silver salt, and more preferably 50% or less. Temperature of such aqueous solution is preferably 0 to 50° C., more preferably 5 to 30° C., and most preferably 5 to 15° C. in particular for the case that the aqueous solution containing the water-soluble silver salt and the aqueous tertiary alcohol solution containing the alkali metal salt of the fatty acid are added at a time as described later.

The alkali metal composing the alkali metal salt of the fatty acid is typified as sodium or potassium. The alkali metal salt of the fatty acid is prepared by adding NaOH or KOH to a fatty acid, in which it is preferable to suppress an amount of the alkali metal less than the equivalence with the fatty acid so that a part of the fatty acid will remain unreacted. The amount of the residual fatty acid is 3 to 50 mol % per mol of the total fatty acid, and preferably 3 to 30 mol %. It is also allowable in the preparation to add an excessive amount of an alkali and then add an acid such as nitric acid or sulfuric acid to neutralize the excessive portion of alkali.

Controlling pH is also allowable depending on target properties of the fatty acid silver salt. An arbitrary acid or alkali can be used for the pH control.

The aqueous solution containing the water-soluble silver salt, the aqueous tertiary alcohol solution containing the alkali metal salt of the fatty acid, and the pre-charged solution in the reaction vessel may be added with, for example, a compound expressed by the formula (1) of JP-A-62-65035, a water-soluble N-heterocyclic compound having a solubility-expressing group as disclosed in JP-A-62-150240, an inorganic peroxide as disclosed in JP-A-50-101019, a sulfur compound as disclosed in JP-A-51-78319, a disulfide compound as disclosed in JP-A-57-643 and hydrogen peroxide.

The aqueous tertiary alcohol solution containing the alkali metal salt of the fatty acid used in the present invention is preferably a mixed solvent of a tertiary alcohol having 4 to 6 carbon atoms and water to ensure uniformity of the solution. A tertiary alcohol having more than 6 carbon atoms is undesirable since such alcohol is not compatible with water. Among alcohols having 4 to 6 carbon atoms, most preferable is t-butanol which is most compatible with water. Alcohols other than tertiary alcohol are not preferable as described above since such alcohols have reducing properties and will thus adversely affect the preparation of the fatty acid silver salt. The amount by volume of the tertiary alcohol used in the aqueous tertiary alcohol solution containing the alkali metal salt of the fatty acid is 3 to 70% of the volume of the aqueous portion of such aqueous tertiary alcohol solution, and more preferably 5 to 50%.

A concentration by weight of the alkali metal salt of the fatty acid in the aqueous tertiary alcohol solution containing thereof is 7 to 50 wt %, more preferably 7 to 45% and still more preferably 10 to 40 wt %.

Temperature of the aqueous tertiary alcohol solution containing the alkali metal salt of the fatty acid to be charged into the reaction vessel is maintained preferably within a range from 50 to 90° C., more preferably from 60 to 85° C., and most preferably from 65 to 85° C., so as to avoid crystallization or solidification of the alkali metal salt of the fatty acid. The temperature is preferably be controlled at a certain level selected from the above range to keep the reaction temperature constant.

The fatty acid silver salt used in the present invention is prepared either by i) a method such that the aqueous tertiary alcohol solution containing the alkali metal salt of the fatty acid is poured by a single addition process into the reaction vessel pre-charged with an entire volume of the solution containing the water-soluble silver salt; or ii) a method such that having a time period in which the aqueous solution of the water-soluble silver salt and the aqueous tertiary alcohol solution containing the alkali salt of the fatty acid are concomitantly added (concomitant addition process). The latter method based on the concomitant addition is more preferable in the present invention in terms of controlling the average grain size of the fatty acid silver salt grains and narrowing the distribution thereof. In such a case, it is preferable that 30 vol % or more of the total addition is concomitantly added, and more preferably 50 to 75 vol %. When either solution is precedently added, the solution containing the water-soluble silver salt in precedence is more preferable.

In both cases, temperature of the solution in the reaction vessel (i.e., the aqueous solution of the water-soluble silver salt precedently charged, or for the case without such precedent charging, the solvent pre-charged in the reaction vessel as described later) is preferably 5 to 75° C., more preferably 5 to 60° C., and most preferably 10 to 50° C. While the temperature is preferably be controlled over the entire process of the reaction at a certain temperature selected from the above range, it is also allowable to control the temperature within the above range according to several temperature patterns.

Temperature difference between the aqueous tertiary alcohol solution containing the alkali metal salt of the fatty acid and the solution in the reaction vessel is preferably within a range from 20 to 85° C., and more preferably from 30 to 80° C. In this case, the aqueous tertiary alcohol solution containing the alkali metal salt of the fatty acid preferably has a higher temperature.

Based on such temperature definition, deposition rate of grains of alkali metal salt of the fatty acid from the aqueous tertiary alcohol solution upon rapid cooling in the reaction vessel and production rate of the fatty acid silver salt through reaction with the water-soluble silver salt are properly controlled thereby to properly control crystal form, crystal size and crystal size distribution of the fatty acid silver salt grains, which concomitantly result in improved properties of the photothermographic material, and in particular of the photothermographic material.

The reaction vessel can be pre-charged with a solvent. While the pre-charged solvent is preferably water, a mixed solvent thereof with the tertiary alcohol is also allowable.

A dispersion aid soluble to water-base medium may be added to the aqueous tertiary alcohol solution of the alkali metal salt of the fatty acid, aqueous solution of the water-soluble silver salt or the reaction solution. The dispersion aid may be of any type provided that it can disperse the produced fatty acid silver salt. Specific examples thereof complies with the description later on the dispersion aid for the fatty acid silver salt.

In a process of producing the fatty acid silver salt in the present invention, it is preferable to provide a desalting and dewatering step after the production of the silver salt. There is no specific limitation on the method therefor, and any of well-known practical means is applicable. Known filtration methods such as centrifugal filtration, suction filtration, ultrafiltration and flocculation washing based on coagulation; and supernatant removal after centrifugal separating sedimentation are preferably used. The desalting and dewatering may be effected once or repeated plural times. Addition and removal of water may be effected continuously or independently. The desalting and dewatering is effected so as to preferably obtain a conductivity of the finally recovered water of approx. 300 $\mu$S/cm or lower, more preferably 100 $\mu$S/cm or lower, and most preferably 60 $\mu$S/cm or lower. While the lower limit of the conductivity is not specifically limited, it is 5 $\mu$S/cm or around in general.

To obtain desirable properties of the coated surface of the photothermographic material, it is preferable to first prepare a water-base dispersion of the fatty acid silver salt, convert it into a high-speed flow under a high pressure, drop the pressure thereof to effect re-dispersion, thereby to obtain a fine water-base dispersion. Although the dispersion medium in this case preferably consists of water only, the medium may contain organic solvent within a content of 20 wt %.

The fatty acid silver salt can mechanically be dispersed in a form of fine grains in the presence of a dispersion aid using a known pulverizing means (e.g., high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill).

To obtain a solid dispersion of the fatty acid silver salt with a high S/N ratio, small grain size and no coagulation, it is preferable in the present invention to apply a large force to the grains of the fatty acid silver salt as an image forming medium within a range such that causing no fracture or excessive temperature rise of the grains. Thus preferable is a dispersion method such that converting a water-base dispersion comprising the fatty silver salt and aqueous dispersion aid solution into a high-speed flow, and then dropping the pressure thereof.

Solid dispersion apparatuses and technologies available for implementing the above re-dispersion in the present invention are detailed, for example, in "Bunsankei Reoroji to Bunsanka Gijutsu (Dispersed System Rheology and Dispersion Technology)", by Toshio Kajiuchi and Hiroki Usui, 1991, issued by Sinzansha Shuppan, p.357–403; "Kagaku Kogaku no Sinpo (Advances in Chemical Engineering) Vol.24", ed. Tokai Section, The Society of Chemical Engineers, 1990, issued by Maki Shoten, p.184–185; JP-A-59-49832; U.S. Pat. No. 4,533,254; JP-A-8-137044; JP-A-8-238848; JP-A-2-261525; and JP-A-1-94933. A dispersion method employed in the present invention is such that feeding the water-base dispersion containing at least fatty silver salt into a piping while being pressurized with a high-pressure pump or the like, allowing the dispersion to pass through a narrow slit, and then causing an abrupt pressure drop of the dispersion thereby to complete a fine dispersion.

As for a high-pressure homogenizer available in the present invention, an uniform and effective dispersion is generally considered to be effected, without altering neither (a) "shearing force" generated when dispersoid passes through a narrow gap (approx. 75 to 350 $\mu$m) under a high pressure and at a high speed, nor (b) "cavitation force" generated by liquid-liquid collision or collision against a wall in a pressurized narrow space, by enhancing the cavitation force by the succeeding pressure drop. Galling homogenizer has long been known as such kind of dispersion apparatus, in which a pressure-fed solution to be dispersed is converted into a high-speed flow at a narrow gap on a cylinder surface, then rushed to be collided with the peripheral wall, thereby allowing emulsification or dispersion assisted by the impact force. The liquid-liquid collision can be effected, for example, in a Y-type chamber of a microfluidizer and a spherical chamber using a ball type check valve as disclosed in JP-A-8-103642 described later, and the liquid-wall collision can be effected, for example, in a Z-type chamber of a microfluidizer. The operating pressure is, in general, selected in a range from 100 to 600 kg/cm$^2$, and a flow rate is in a range from several to 30 m/second. There is also proposed an apparatus such that having a sawtoothed high flow rate portion to increase the number of collision for a higher dispersion efficiency. Typical examples of such apparatuses include galling homogenizer, microfluidizer manufactured by Microfluidex International Corporation or Mizuho Kogyo K. K., and Nanomizer manufactured by Tokushu Kika Kogyo Co., Ltd. Such apparatuses are also disclosed in JP-A-8-238848, JP-A-8-103642 and U.S. Pat. No. 4,533,254.

The fatty acid silver salt can be dispersed so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3,000 kg/cm$^2$, and more preferably from 1,500 to 3,000 kg/cm$^2$. The number of repetition of the process is selectable as required. While this is generally selected as once to as much as 10 times, preferable in view of productivity is from once to 3 times. Raising the temperature of such water dispersion under high pressure is undesirable from the viewpoint of dispersibility and photographic properties, that is, raising the temperature above 90° C. tends to result in increased grain size and increased fog. It is thus preferable in the present invention to provide a cooling step before the conversion into the high-pressure, high-speed flow and/or after the pressure drop, to maintain the temperature of the water dispersion within a range from 5 to 90° C., more preferably from 5 to 80° C., and still more preferably 5 to 65° C. Providing such cooling step is exceptionally effective when the dispersion is proceeded under the pressure as high as 1,500 to 3,000 kg/cm$^2$. A cooler is properly selected, depending on the required capacity of heat exchange, from those being equipped with a double pipe or triple pipe as combined with a static mixer; shell-and-tube heat exchanger; and coiled heat exchanger. The diameter, wall thickness and material of the pipe may properly be selected, considering the operating pressure, so as to improve the efficiency of the heat exchange. Coolants available for the cooler include well water at 20° C.; cold water at 5 to 10° C. fed from a chiller; and, as requested, ethylene glycol/water at −30° C.

When the fatty acid silver salt is dispersed in a form of solid micrograms using a dispersion aid, the dispersion aid can be properly selected from, for example, synthetic anionic polymers such as polyacrylic acid, acrylic acid copolymers, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; anionic surfactant disclosed in JP-A-52-92716 and International Patent Publication WO88/04794; a compound disclosed in JP-A-9-179243; and known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like.

The dispersion aid is generally mixed with the fatty acid silver salt in a form of powder or wet cake before the dispersing operation, and fed as slurry into a dispersion apparatus, whereas the dispersion aid may also be included in the powder or wet cake by heat treatment or solvent treatment of the dispersion aid premixed with the fatty acid silver salt. The pH may be controlled with a suitable pH adjusting agent during, before or after the dispersing operation.

Besides such mechanical dispersing operation, the fatty acid silver salt can preliminarily be dispersed into solvent by pH control, and then can thoroughly be dispersed by altering pH under the presence of the dispersion aid. The solvent for the preliminary dispersion may be an organic solvent, which is generally removed after the thorough dispersion.

The produced dispersion can be stored under stirring in order to prevent precipitation of the micrograms during storage, or stored in a highly viscous state by producing hydrophilic colloid (e.g., jelly state formed with gelatin). Further, it may be added with a preservative in order to prevent germ proliferation during the storage.

Prior to the dispersion process, the source liquid is roughly dispersed (preliminary dispersion). Known dispersion means (e.g., high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill) is adoptable to the preliminary dispersion. Besides such mechanical dispersing operation, the fatty acid silver salt can preliminarily be dispersed into solvent by pH control, and then can thoroughly be dispersed by altering pH under the presence of the dispersion aid. The solvent for the preliminary dispersion may be an organic solvent, which is generally removed after the thorough dispersion.

The aqueous solution of the photosensitive silver salt is mixed thereto after such fine dispersion to provide a coating liquid for a photosensitive image producing medium. Using such coating liquid ensures a photothermographic material with a low haze, low fog and high sensitivity. On the contrary, presence of the photosensitive silver salt at the time of dispersion through the conversion into high-pressure, high-speed flow tends to result in increased fog and significantly lowered sensitivity. Using an organic solvent, in place of water, also tends to raise the haze, increase the fog and lower the sensitivity. In place of mixing the aqueous solution of the photosensitive silver salt, employing the conversion method, in which a part of the fatty acid silver salt in the dispersion is converted into photosensitive silver salt, may lower the sensitivity.

Grain size (volume weighted mean diameter) of the solid microgram dispersion of the fatty acid silver salt can be measured by, for example, irradiating laser light to the solid microgram dispersion in a liquid state and deriving an autocorrelation function with respect to the time-dependent fluctuation in the scattered light intensity. An average grain size of the solid microgram dispersion is preferably within a range from 0.05 to 10.0 $\mu$m, more preferably 0.1 to 5.0 $\mu$m, and still more preferably 0.1 to 2.0 $\mu$m.

The solid microgram dispersion of the fatty acid silver salt preferably used in the present invention comprises at least an fatty acid silver salt and water. While there is no specific limitation on the ratio of the fatty acid silver salt and water, the fatty acid silver salt preferably accounts for 5 to 50 wt % of the total weight of the dispersion, and more preferably 10 to 30 wt %. Using a dispersion aid described previously is preferable provided that it is used in a minimum amount within a range suitable for minimizing the grain size, and preferable range thereof is 1 to 30 wt % of the fatty acid silver salt, and more preferably 3 to 15 wt %.

The fatty acid silver salt can be used in a desired amount, where 0.1 to 5 g/m$^2$ as an amount of silver is preferable and 1 to 3 g/m$^2$ is more preferable.

The photothermographic material of the present invention contains the photosensitive silver halide grains. The photosensitive silver halide grains used in the present invention have an average grain size of 10 nm to 50 nm, and more preferably 10 nm to 45 nm, and still more preferably 10 to 40 nm. The average grain size of the photosensitive silver halide grains can be adjusted by properly controlling the liquid temperature during the grain formation and the amount of addition of the yellow prussiate of potash (potassium ferrocyanide) as described later in Example 2.

The average grain size is now defined as a diameter of a virtual sphere having a volume equivalent to that of the silver halide grain. Such grain size can readily be obtained through microscopic observation and the like.

The photosensitive silver halide used in the present invention has no specific limitation in the halogen composition thereof, and any of silver chloride, silver chlorobromide, silver bromide, silver iodobromide and silver iodochlorobromide is available. The halogen composition distribution within the grain may be uniform, or the halogen composition may vary stepwise or continuously. Silver halide grain with a core/shell structure may preferably be used, in which the structure is preferably of two- to five-fold, and more preferably of two- to four-fold. It is also preferable to adopt a technique for localizing silver bromide on the surface of silver chloride or silver cholorobromide.

Methods for producing photosensitive silver halide grains used in the present invention are well known in the art, and, for example, the methods described in *Research Disclosure,* No. 17029 (June, 1978) and U.S. Pat. No. 3,700,458 may be applied. The method applicable to the present invention relates to such that adding a silver source compound and a halogen source compound to gelatin or other polymer solution thereby to prepare photosensitive silver halide grains, and then mixing them with a fatty acid silver salt grains.

Examples of the shape of the silver halide grain include cubic, octahedral, tabular, spherical, rod and pebble; among these, cubic being preferred in the present invention. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye accounts for a large percentage. The percentage is preferably 50% or above, more preferably 65% or above, still more preferably 80% or above. The percentage of a plane with a Miller index of [100] can be determined by the method described in T. Tani, *J. Imaging Sci.,* 29, 165 (1985), which is based on the plane dependency of adsorption of the sensitizing dye between [111] and [100] planes.

The photosensitive silver halide grain contains a metal of Groups VIII to X in the Periodic Table (showing Groups I to XVIII), or complexes thereof. Such metal or a center metal of the metal complex is preferably rhodium, rhenium, ruthenium, osmium or iridium. These metals or metal complexes may be used individually, and two or more metal complexes having the same metal or different metals may be used in combination. Content of the metal or metal complex is preferably from $1.10^{-9}$ to $1.10^{-3}$ mol per mol of silver in the silver halide. Such metal complexes are described in the paragraphs [0018] to [0024] of JP-A-11-65021.

Among these, iridium is preferably contained in the silver halide grain in the present invention. Specific examples of the iridium compound include hexachloroiridium, hexammineiridium, trioxalatoiridium, hexacyanoiridium and pentachloronitrosyliridium. These iridium compounds are used in a dissolved form in water or other appropriate solvent. It is also allowable to add an aqueous hydrogen halide solution (e.g., hydrochloric acid, bromic acid, fluoric acid) or alkali halide (e.g., KCl, NaCl, KBr, NaBr), which are the common methods for stabilizing the solution of the iridium compound. Or the silver halide can also be prepared by adding and dissolving a separate silver halide grain pre-doped with iridium. Amount of addition of the iridium compound is preferably from $1.10^{-8}$ to $1.10^{-3}$ mol per mol of silver halide, and more preferably from $1.10^{-7}$ to $5.10^{-4}$ mol/mol Ag.

As for metal complexes (for example, $[Fe(CN)_6]^{4-}$) possibly contained in the silver halide grains for use in the present invention, applicable methods for desalting or chemical sensitization are disclosed in the paragraphs [0046] to [0050] of JP-A-11-84574, and the paragraphs [0025] to [0031] of JP-A-11-65021.

One preferable method relates to addition of yellow prussiate of potash after the grain formation in order to suppress the grain growth.

The sensitizing dye may advantageously be selected from those capable of spectrally sensitizing the silver halide grains in a desired wavelength region by adhering thereon, and having a spectral sensitivity suitable for spectral characteristics of an exposure light source. Sensitizing dyes and methods for adding thereof are described in the paragraphs [0103] to [0109] of JP-A-11-65021, expressed by the formula (II) of JP-A-10-186572, and described from line 38 on page 19 to line 35 on page 20 of European Laid-Open Patent Publication No. 0803764A1. Among these, particularly preferable sensitizing dye is such that having a —$COOR^1$ group, where $R^1$ represents a hydrogen atom, alkali metal atom or alkyl group having 1 to 6 carbon atoms. The silver halide spectrally sensitized with such sensitizing dye having such group can markedly suppress the time-dependent desensitization when it is used in combination with the water-soluble mercapto compound used in the present invention.

The sensitizing dye is added into the silver halide emulsion preferably in a period from the completion of the desalting to the start of the coating, and more preferably from the desalting to the start of the chemical ripening.

In the present invention, the photosensitive silver halide grains are preferably subjected to chemical sensitization by the sulfur sensitization, selenium sensitization or tellurium sensitization. Preferable compounds for the sulfur, selenium or tellurium sensitization are found in, for example, JP-A-7-128768. Particularly preferable in the present invention is the tellurium sensitization, and examples of the tellurium sensitizer include diacyl tellurides, bis(oxycarbonyl) tellurides, bis(carbamoyl) tellurides, diacyl ditellurides, bis (oxycarbonyl) ditellurides, bis(carbamoyl) ditellurides, compounds having a P═Te bond, tellurocarboxylates, tellurosulfonates, compounds having a P-Te bond and tellurocarbonyl compounds. Specific examples thereof relate to the compounds disclosed in the paragraph [0030] of JP-A-11-65021. The compounds expressed by formulae (II), (III) and (IV) of JP-A-5-313284 are particularly preferred.

In the present invention, the chemical sensitization may come into effect at any timing provided that it is after the grain production and before the coating, and it may be effected after the desalting and (1) before the spectral sensitization, (2) simultaneously with the spectral sensitization, (3) after the spectral sensitization, or (4) immediately before the coating. It is in particular preferable to perform it after the spectral sensitization.

The amount of the sulfur, selenium or tellurium sensitizer used in the present invention varies depending on species of the silver halide grains used or chemical ripening conditions. However, it is generally from $10^{-8}$ to $10^{-2}$ mol per mol of silver halide, preferably on the order of from $10^{-7}$ to $10^{-3}$ mol. While the conditions for chemical sensitization in the present invention are not particularly restricted, pH is generally from 5 to 8; pAg is from 6 to 11, preferably from 7 to 10; and temperature is from 40 to 95. C., preferably from 44 to 70. C.

In the photosensitive material used for the present invention, a single kind of silver halide emulsion may be used, or two or more kinds of silver halide emulsions (for example, those differ in the average grain size, halogen composition, crystal habit or chemical sensitization conditions) may be used in combination. Using a two or more kinds of photosensitive silver halides differ in sensitivity allows gradation control. Related technologies are disclosed, for example, in JP-A-57-119341, JP-A-53-106125, JP-A-47-3929, JP-A-48-55730, JP-A-46-5187, JP-A-50-73627 and JP-A-57-150841. Sensitivity difference among individual emulsions is preferably 0.2 logE each or larger.

Content of silver halide as expressed in a coated amount of silver per 1 $m^2$ of the photosensitive material is preferably 0.03 to 0.6 $g/m^2$, more preferably 0.05 to 0.4 $g/m^2$, and still more preferably 0.1 to 0.4 $g/m^2$. The amount of the photosensitive silver halide used in the present invention is preferably from 0.01 to 0.5 mol per mol of the fatty acid silver salt, more preferably from 0.03 to 0.3 mol, still more preferably from 0.07 to 0.25 mol.

As described in the above, the fatty acid silver salt grains and silver halide grains independently prepared are mixed with each other before the coating. A preferable timing for adding the silver halide grains to the coating liquid containing the fatty acid silver salt grains resides in a period from 180 minutes before to immediately before the coating, and more preferably from 60 minutes before to 10 seconds before. There is no specific limitation on the method or conditions for the mixing provided that sufficient effects of the present invention will be obtained. Specific examples of the method include such that using a tank devised so that an average retention time estimated based on the addition flow rate and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

The photothermographic material of the present invention contain a reducing agent for reducing silver ion. The reducing agent may be an arbitrary substance (preferably an organic substance) capable of reducing silver ion into metal silver. Descriptions for such reducing agents are found in the paragraph [0043] to [0045] of JP-A-11-65021, and from line 34 on page 7 to line 12 on page 18 of European Patent No. 080376A 1. In the present invention, especially preferable ones relate to bisphenol-base reducing agents [such as 1,1-bis(2-hydroxy-3,5-dimethylphenyl)-3,5,5-trimethylhexane, bis-(2-hydroxy-3-t-butyl-5-methylphenyl) methane, bis(2-hydroxy-3-t-butyl-5-ethylphenyl)methane, 2,2'-isobutylidene-bis-(4,6-dimethyl-phenol)]. The amount of addition of the reducing agent is preferably 0.01 to 5.0 $g/m^2$, more preferably 0.1 to 3.0 $g/m^2$, and when expressed in a molar percent per mol of total silver presents on the image producing layer side, it is preferably 5 to 50 mol %, and more preferably 10 to 40 mol %.

The reducing agent can be added to the coating liquid and thus included in the photosensitive material in any form of solution, emulsified dispersion or solid microgram dispersion.

A well-known method for preparing the emulsified dispersion relates to dissolving the reducing agent in oil such as dibutyl phthalate, tricresyl phosphate, glyceryl triacetate and diethyl phthalate, or in auxiliary solvent such as ethyl acetate and cyclohexanone, and then mechanically emulsifying the mixture.

A method for obtaining the solid microgram dispersion relates to dispersing powder of the reducing agent into an appropriate solvent such as water using ball mill, vibrating ball mill, sand mill, colloid mill, jet mill, roller mill or with the aid of ultrasonic wave. It is also allowable in this process to use a protective colloid (e.g., polyvinyl alcohol) or an anionic surfactant (for example, sodium triisopropylnaphthalenesulfonate as a mixture of isomers differed in the substitution sites by three isopropyl groups). The water-base dispersion can contain a preservative (e.g., benzoisothiazolinone sodium salt).

In the present invention, preferable is the photothermographic material where the fatty acid silver salt-containing layer is formed by coating and drying a coating liquid, in which water accounts for 30 wt % or above of the solvent thereof, and the photothermographic material where a binder in the fatty acid silver salt-containing layer comprises a polymer latex which is soluble or dispersible in a water-base solvent and in particular has an equilibrium moisture content of 2 wt % or below at 25° C. and relative humidity of 60%. A most preferable embodiment relates to the polymer latex prepared so as to have an ion conductivity of 2.5 mS/cm or below. Such polymer latex can be obtained by purifying a synthesized polymer using a separation functional membrane.

A water-base solvent capable of dispersing the polymer latex refers to water or water mixed with 70 wt % or less thereof of a water-miscible organic solvent. Examples of the water-miscible solvent include alcohols such as methanol, ethanol and propanol; Cellosolves such as Methyl Cellosolve, Ethyl Cellosolve and Butyl Cellosolve; ethyl acetate and dimethylformamide.

The term "water-base solvent" is now also used herein to express a system in which polymer is not solubilized in a thermodynamic sense but exists in a dispersed form.

"The equilibrium moisture content at 25° C., 60%RH" is expressed by an equation such as equilibrium moisture content at 25° C., 60% RH=[(W1-W0)/W0]×100 (wt %) where, W1 represents polymer weight under humidity conditioning equilibrium in an environment of 25° C. and 60%RH, and W0 represents polymer weight under bone dry equilibrium.

Definition and measurement method of water content can be referred to the description of "Kobunshi Zairyo Shikenho (Test Methods for Polymer Materials)" in the series of "Kobunshi Kogaku Koza 14 (Polymer Engineering Course 14)", edited by Polymer Society, published by Chijin Shokan.

An equilibrium moisture content at 25° C., 60%RH of the binder polymer used in the present invention is preferably 2 wt % or less, more preferably 0.01 to 1.5 wt %, and still more preferably 0.02 to 1 wt %.

Quite preferable in the present invention is a polymer dispersible in the water-base solvent.

Possible dispersion forms include such that micrograms of solid polymer are dispersed to form a latex, and such that polymer molecules are dispersed in a molecular state or form micells, either of which being preferable.

In a preferred embodiment of the present invention, preferably used are hydrophobic polymers such as acrylic resin, polyester resin, rubber-base resin (for example, SBR resin), polyurethane resin, vinyl chloride resin, vinyl acetate resin, vinylidene chloride resin and polyolefin resin. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 200,000. Too small molecular weight will result in poor mechanical strength of the emulsion layer, whereas too large in undesirable film-forming property.

The "water-base solvent" refers to a dispersion medium such that 30 wt % or more of the composition of which being composed of water. Any mode of dispersion, such as emulsified dispersion, micellar dispersion, or molecular dispersion of polymer having in the molecule a hydrophilic portion, is allowable, and most preferable mode can be found in latex.

Preferable examples of the polymer latex are listed below, in which polymers are expressed with source monomers, and numerals in the parentheses denote contents in wt % and the molecular weights represent number average molecular weights:

P-1; latex expressed as —MMA(70)—EA(27)—MAA(3)— (M.W. 37,000)

P-2; latex expressed as —MMA(70)-2EHA(20)—St(5)—AA(5)— (M.W. 40,000)

P-3; latex expressed as —St(50)—Bu(47)—MAA(3)— (M.W. 45,000)

P-4; latex expressed as —St(68)—Bu(29)—AA(3)— (M.W. 60,000)

P-5; latex expressed as —St(70)—Bu(27)—IA(3)— (M.W. 120,000)

P-6; latex expressed as —St(75)—Bu(24)—AA(1)— (M.W. 108,000)

P-7; latex expressed as —St(60)—Bu(35)—DVB(3)—MAA(2)— (M.W. 150,000)

P-8; latex expressed as —St(70)—Bu(25)—DVB(2)—AA(3)— (M.W. 280,000)

P-9; latex expressed as —VC(50)—MMA(20)—EA(20)—AN(5)—AA(5)— (M.W. 80,000)

P-10; latex expressed as —VDC(85)—MMA(5)—EA(5)—MAA(5)— (M.W. 67,000)

P-11; latex expressed as —Et(90)—MAA(10)— (M.W. 12,000)

P-12; latex expressed as —St(70)—2EHA(27)—AA(3)— (M.W. 130,000)

P-13; latex expressed as —MMA(63)—EA(35)—AA(2)— (M.W. 33,000)

The abbreviations in the above structures correspond with monomers as follows: MMA=methyl methacrylate, EA=ethyl acrylate, MAA=methacrylic acid, 2EHA=2-ethylhexyl acrylate, St=styrene, Bu=butadiene, AA=acrylic acid, DVB=divinylbenzene, VC=vinyl chloride, AN=acrylonitrile, VDC=vinylidene chloride, Et=ethylene, and IA=itaconic acid.

Such polymers are also commercially available, which include acrylic resins such as CEBIAN A-4635, 46583 and 4601 (all produced by Dicel Kagaku Kogyo K. K.) and Nipol Lx811, 814, 821, 820, 857 (all produced by Nippon Zeon K. K.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon K. K.); vinyl chloride resins such as G351, G576 (both produced by Nippon Zeon K. K.); vinylidene chloride resins such as L502, L513 (both produced by Asahi Chemical Industry Co., Ltd.); and olefin resins such as CHEMIPEARL S120 and SA100 (both produced by Mitsui Chemical Co., Ltd.).

These polymers may be used individually or, as required, as a blend of two or more thereof.

A latex of styrene-butadiene copolymer is in particular preferable as the polymer latex used in the present invention. A weight ratio of styrene monomer unit and butadiene monomer unit in the styrene-butadiene copolymer is preferably 40:60 to 95:5. The styrene monomer unit and butadiene monomer unit preferably account for 60 to 99 wt % of the copolymer. A preferable range for the molecular weight thereof is the same as described previously.

The latex of the styrene-butadiene copolymer preferably used in the present invention is typified as P-3 to P-8 listed above and commercially available LACSTAR-3307B, 7132C, and Nipol Lx416.

To the fatty acid silver salt-containing layer, it is allowable to add, as required, hydrophilic polymer such as gelatin, polyvinyl alcohol, methylcellulose and hydroxypropylcellulose. The amount of addition of these hydrophilic polymers is preferably 30 wt % or less of the total binder of the fatty acid silver salt-containing layer, and more preferably 20 wt % or less.

The fatty acid silver salt-containing layer (i.e., image producing layer) in the present invention is preferably formed using the polymer latex. A content of the binder in the fatty acid silver salt-containing layer, expressed by a weight ratio of the total binder and the fatty acid silver salt, is preferably 1/10 to 10/1, and more preferably 1/5 to 4/1.

Such fatty acid silver salt-containing layer is usually a photosensitive layer (emulsion layer) containing a photosensitive silver halide as a photosensitive silver salt, and in such a case, the weight ratio of the total binder and the silver halide is preferably 400 to 5, and more preferably 200 to 10.

The amount of the total binder of the image producing layer is preferably 0.2 to 30 g/m$^2$, and more preferably 1 to 15 g/m$^2$. The image-recording layer may be added with a cross-linking agent for crosslinking or a surfactant for improving coating property.

In the present invention, the solvent (herein for simplicity, the solvent and dispersoid are inclusively termed as "solvent") for preparing the coating liquid for the fatty acid silver salt-containing layer of the photothermographic material is preferably a water-base solvent containing 30 wt % or more thereof of water. Possible component of the coating liquid other than water may be an arbitrary water-miscible organic solvent such as methanol, ethanol, isopropanol, Methyl Cellosolve, Ethyl Cellosolve, dimethylformamide or ethyl acetate. Water content of the solvent for the coating liquid is preferably 50 wt % or above, and more preferably 70 wt % or above. Preferable examples of the solvent composition include water, water/methanol=90/10, water/methanol=70/30, water/methanol/dimethylformamide=80/15/5, water/methanol/Ethyl Cellosolve=85/10/5, and water/methanol/isopropanol=85/10/5 (the numerals are in wt %).

Appropriate examples of antifoggants, stabilizers and stabilizer precursors, available individually or in combination, include those described in paragraph [0070] of JP-A-10-62899 and from line 57 on page 20 to line 7 on page 21 of European Laid-Open Patent Publication No. 0803764A1. The antifoggant preferably used in the present invention is organic halide, and the typical compounds are disclosed in the paragraphs [0111] to [0112] of JP-A-11-65021. In particular preferable are compounds expressed by the formula (II) as disclosed in JP-A-10-339934 (more specifically, tribromomethylnaphthylsulfone, tribromomethylphenylsulfone, and tribromomethyl-[4-(2,4,6-trimethylphenylsulfonyl)phenyl]sulfone, N-butyl-3-tribromomethanesulfonylbenzamide).

Methods for incorporating the antifoggant into the photosensitive material may be same as those for incorporating the reducing agent described above, and also the organic polyhalogen compound can preferably added in a form of solid microgram dispersion.

Other possible antifoggant include a mercury (II) salt disclosed in the paragraph [0113] of JP-A-11-65021, and benzoic acids disclosed in the paragraph [0114] of the same patent publication.

The photothermographic material of the present invention may contain azolium salts for preventing fog. Examples of azolium salts include those expressed by the formula (XI) in JP-A-59-193447, those disclosed in JP-B-55-12581, and those expressed by the formula (II) in JP-A-60-153039. Although the azolium salts may be added to any portion of the photosensitive material, addition to a layer provided on the same side with the photosensitive layer is preferable, and to an fatty acid silver salt-containing layer is more preferable. The azolium salts may be added at any step during the preparation of the coating liquid. In the case of addition to the fatty acid silver salt-containing layer, they may be added at any step within a period from the preparation of the fatty acid silver salt to the preparation of the coating liquid, where addition in a period following the preparation of the fatty acid silver salt and immediately before the coating is preferable. The azolium salts may be added in any form of solution, powder or solid microgram dispersion. It is also allowable to add them in a form of mixed solution containing other additives such as a sensitizing dye, reducing agent and toner. The amount of addition of the azolium salts can arbitrarily be set, where a preferable range being from $1\times10^{-6}$ to 2 mol, per mol of silver, and more preferably from $1\times10^{-3}$ to 0.5 mol.

The photothermographic material of the present invention may contain mercapto compound, disulfide compound or thione compound so as to control the development by inhibiting or accelerating thereof, to improve the spectral sensitization efficiency, or to improve the storage stability before and after the development. Such compounds are disclosed in the paragraphs [0067] to [0069] of JP-A-10-62899, expressed by the formula (I) and specifically described in the paragraphs [0033] to [0052] of JP-A-10-186572, and described in lines 36 to 56 on page 20 of European Laid-Open Patent Publication No. 0803764A1. Among these, particularly preferable are mercapto-substituted heteroaromatic compounds.

Adding a toner is preferable in the present invention. Toners are described in the paragraphs [0054] to [0055] of JP-A-10-62899, and in lines 23 to 48 on page 21 of European Laid-Open Patent Publication No. 0803764A1, and preferable examples of which include phthalazinone; phthalazinone derivatives or metal salts; derivatives such as 4-(1-naphthyl)phthalazinone, 6-chlorophthalazinone, 5,7-dimethoxyphthalazinone or 2,3-dihydro-1,4-phthalazinedione; combination of phthalazinone and phthalic acid derivatives (e.g., phthalic acid, 4-methylphthalic acid, 4-nitrophthalic acid and tetrachlorophthalic anhydride); phthalazines (e.g., phthalazine, phthalazine derivatives or metal salts, or 4-(1-naphthyl) phthalazine, 6-isopropylphthalazine, 6-t-butylphthalazine, 6-chlorophthalazine, 5,7-dimethoxyphthalazine, and 2,3-dihydrophthalazine); and combinations of phthalazines and phthalic acid derivatives (e.g., phthalic acid, 4-methylphthalic acid, 4-nitrophthalic acid tetrachlorophthalic anhydride); among which combinations of phthalazines and phthalic acid derivatives being preferable.

Plasticizer and lubricant available for the photosensitive layer are disclosed in the paragraph [0117] of JP-A-11-65021; ultrahigh contrast agents for producing a ultrahigh contrast image are disclosed in the paragraph [0118] of the same patent publication, and are expressed by the formulae (III) to (V) in Japanese Patent Application No. 11-91652 (specifically Compounds 21 to 24); and contrast accelerators are disclosed in the paragraph [0102] of JP-A-11-65021.

The photothermographic material of the present invention may have a surface protective layer for preventing adhesion of the image producing layer. The surface protective layer is described in the paragraphs [0119] to [0120] of JP-A-11-65021.

While gelatin is preferably used as a binder for the surface protective layer, polyvinyl alcohol (PVA) is also a preferable candidate. Examples of PVA include a fully saponified PVA-105 [PVA content≧94.0 wt %, saponification ratio=98.5±0.5 mol%, sodium acetate content≧1.5 wt %, volatile matter content≧5.0 wt %, viscosity (4 wt %, 20° C.)=5.6±0.4 mPa·s]; partially saponified PVA-205 [PVA content=94.0 wt %, saponification ratio=88.0±1.5 mol %, sodium acetate content=1.0 wt %, volatile matter content=5.0 wt %, viscosity (4wt %, 20° C.)=5.0±0.4 mPa·s]; and modified polyvinyl alcohol named MP-102, MP-202, MP-203, R-1130 and R-2105 (all of which being product names by Kuraray Co., Ltd.). The amount of coating of polyvinyl alcohol (per 1 $m^2$ of the support) for the protective layer (per layer) is preferably 0.3 to 4.0 $g/m^2$, and more preferably 0.3 to 2.0 $g/m^2$.

Preparation temperature of the coating liquid for the image producing layer is preferably 30 to 65° C., more preferably 35 to 60° C., and still more preferably 35 to 55° C. It is also preferable to keep the temperature of the coating liquid for the image producing layer at 30 to 65° C. immediately after the addition of the polymer latex. The reducing agent and the fatty acid silver salt are preferably mixed with each other before the polymer latex is added.

The fatty acid silver salt-containing fluid or the coating liquid for the image producing layer is preferably a so-called thixotropic fluid. Thixotropy refers to a property such that the viscosity decreases as the shearing velocity increases. While any type of apparatus is available for viscosity measurement, preferable measurement can be performed at 25° C. using RFS Fluid Spectrometer manufactured by Rheometric Far East Inc. In the present invention, the viscosity of the fatty acid silver salt-containing fluid or the coating liquid for the image producing layer under a shearing velocity of 0.1 $S^{-1}$ is preferably 400 to 100,000 mPa·s, and more preferably 500 to 20,000 mPa·s. Such viscosity under a shearing velocity of 1,000 $S^{-1}$ is preferably 1 to 200 mPa·s, and more preferably 5 to 80 mPa·s.

There are known various systems exerting thixotropy and they can be found in "Koza—Reoroji (Rheology Course)" edited by Kobunshi Kanko-kai, and "Kobunshi Ratekkusu (Polymer Latex)" collaborated by Muroi and Morino. It is necessary for fluid to contain a large amount of solid micrograms for exhibiting thixotropy. Thixotropy can advantageously be enhanced by including a thickening linear polymer, increasing an aspect ratio of solid microgram with an anisotropic shape, or using an alkali thickener or surfactant.

The photothermographic emulsion used in the present invention forms on the support one or more layers. In the monolayer constitution, the layer must contain fatty acid silver salt, silver halide, reducing agent and binder, and may contain toner, coating aid and other auxiliary agents. In the double-layer constitution, a first emulsion layer (usually adjacent to the substrate) must contain fatty acid silver salt and silver halide, and a second layer or both layer must contain some other components. Alternative double-layer constitution may be allowable, in which a single emulsion layer contains all components and a protective topcoat is provided thereon. A multicolor photothermographic material may have a structure such that a combination of the above-described two layers is provided for the respective colors, or, as described in U.S. Pat. No. 4,708,928, a structure such that a single layer contains all components. In the case of a multi-dye multi-color photothermographic material, the respective emulsion layers are generally kept away from each other by using a functional or non-functional barrier layer between the respective photosensitive layers as described in U.S. Pat. No. 4,460,681.

The photosensitive layer may contain a dye or pigment of various types so as to improve the color tone, to prevent interference fringes at the time of the laser exposure, or to prevent the irradiation. This is described in detail in WO 98/36322. Examples of dyes and pigments suitable for the photosensitive layer include anthraquinone dye, azomethine dye, indoaniline dye, azo dye, anthraquinon-base indanthrone dye (for example, C.I. Pigment Blue 60), phthalocyanine dye (for example, copper phthalocyanine such as C.I. Pigment Blue 15, and metal-free phthalocyanine such as C.I. Pigment Blue 16), dying lake pigment-base triarylcarbonyl pigment, indigo, and inorganic pigment (for example, ultramarine blue, cobalt blue). The dye may be added in any form of solution, emulsified product or solid microgram dispersion or may be added in the state mordanted with a polymer mordant. The amount of such compounds used may be determined according to desired absorbance, and, in general, the compounds are preferably used in an amount of from $1.10^{-6}$ to 1 g per 1 $m^2$ of the photosensitive material.

In the present invention, an antihalation layer may be provided on the side more distant from the light source than the photosensitive layer is. Description on the antihalation layer can be found in the paragraphs [0123] to [0124] of JP-A-11-65021.

It is preferable in the present invention to add a fading dye and basic precursor to the non-photosensitive layer to make it function as a filter layer or antihalation layer. The photothermographic material generally has, in addition to the photosensitive layer, the non-photosensitive layer. The non-photosensitive layer can be classified by the arrangement thereof into (1) a protective layer provided on the photosensitive layer (on the side more distant from the support), (2) an intermediate layer provided between a plurality of the photosensitive layers or between the photosensitive layer and the protective layer, (3) an undercoat layer provided between the photosensitive layer and the support, and (4) a back layer provided on the opposite side of the photosensitive layer. The filter layer is provided to the photosensitive material as a layer classified as (1) or (2), whereas the antihalation layer is provided thereto as a layer classified as (3) or (4).

The fading dye and basic precursor are preferably added in the same non-photosensitive layer, where adding separately into the two adjacent non-photosensitive layers is also allowable. A barrier layer can be provided between two non-photosensitive layers.

The fading dye may be added to the non-photosensitive layer in any form of solution, emulsified product or solid microgram dispersion, or may be added by mixing polymer immersed material to the coating liquid for the non-photosensitive layer. It is also allowable to add the dye to the non-photosensitive layer using a polymer mordant. These methods of addition are the same as the general methods for adding the dye to the photothermographic material. Latex used for the polymer immersed material is described in U.S. Pat. No. 4,199,363, German Laid-Open Patent Publication Nos. 25,141,274 and 2,541,230, European Laid-Open Patent Publication No. 029,104 and JP-B-53-41091. An emulsifying method in which the dye is added into the polymer dissolved solution is disclosed in WO 88/00723.

The amount of addition of the fading dye is determined according to the purpose of use of the dye. In general, the fading dye is used in an amount affording an optical density (absorbance) measured at a target wavelength exceeding 0.1. The optical density is preferably 0.2 to 2. The amount of use of the dye to afford such optical density is approx. 0.001 to 1 $g/m^2$ in general, and more preferably approx. 0.01 to 0.2 $g/m^2$.

Such fading of the dye can make the optical density suppressed to 0.1 or below. Two or more fading dyes may be used together for the heat-fading recording material or photothermographic material. Similarly, two or more basic precursors may be used together.

The photothermographic material of the present invention is preferably of a so-called single-sided type comprising a support having on one side thereof at least one photosensitive layer containing silver halide emulsion, and on the other side thereof a back layer. In the present invention, a matting agent is preferably added to improve the conveyance property. The matting agent is described in the paragraphs [0126] to [0127] of JP-A-11-65021. The coated amount of the matting agent per 1 $m^2$ of the photosensitive material is preferably 1 to 400 $mg/m^2$, and more preferably 5 to 300 $mg/m^2$.

While there is no particular limitation on the degree of matting so long as stardust failure does not occur, the Bekk smoothness falls preferably within a range from 30 to 2,000 seconds, and more preferably 40 to 1,500 seconds.

The degree of matting of the back layer is preferably expressed as a Bekk smoothness of 10 to 1,200 seconds, more preferably 20 to 800 seconds, and still more preferably 40 to 500 seconds.

In the present invention, the matting agent is preferably added to an outermost layer or a layer functions as the outermost layer of the photosensitive material, or to a layer provided near the outer surface thereof, and in particular to a layer functions as a so-called protective layer.

The back layer applicable to the present invention is described in the paragraphs [0128] to [0130] of JP-A-11-65021.

The individual layers including the photosensitive layer, protective layer and back layer may contain a film hardening agent. Various method of use of the film hardening agent are described in "The Theory of the Photographic Process 4th Edition" by T. H. James, published by Macmillan Publishing Co., Inc. (1977), pages 77 to 87, and preferably used are polyvalent metal ion described on page 78 of this publication; polyisocyanates described in U.S. Pat. No. 4,281,060 and JP-A-6-208193; epoxy compounds described, for example, in U.S. Pat. No. 4,791,042; and vinyl sulfone compounds described, for example, in JP-A-62-89048.

The film hardening agent is added in a form of solution, and preferable timing for adding thereof to the coating liquid for the protective layer resides in a period from 180 minutes before to immediately before the coating, and more preferably from 60 minutes before to 10 seconds before. There is no specific limitation on method or conditions for the mixing provided that sufficient effects of the present invention will be ensured. Specific examples of the method include such that using a tank devised so that an average retention time estimated based on the flow rate during the addition and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

Various materials applicable to the present invention are disclosed in JP-A-11-65021, in which surfactants are disclosed in the paragraph [0132], solvents in [0133], supports in [0134], antistatic measures or conductive layers in [0135], and methods for obtaining a color image in [0136].

The transparent support may be colored with a blue dye (for example, Dye-1 described in Example of JP-A-8-240877), or may be colorless. Undercoat techniques for the support are described in JP-A-11-84574 and JP-A-10-186565. With regard to antistatic layer or undercoating, it is also allowable to use the techniques described in JP-A-56-143430, JP-A-56-143431, JP-A-58-62646 and JP-A-56-120519.

The photothermographic material of the present invention is preferably of monosheet type (a type such that allowing forming an image thereon without using other sheets such as an image receiving material).

The photothermographic material of the present invention may be added with an antioxidant, stabilizer, plasticizer, ultraviolet absorbing agent and coating aid. These additives are added to either the photosensitive layer or non-photosensitive layer making reference to WO 98/36322, European Patent No. 803764A1, JP-A-10-186567 and JP-A-10-18568.

The photothermographic material in the present invention may be formed by a variety of coating processes, which include extrusion coating, slide coating, curtain coating, dip coating, knife coating, flow coating, and extrusion coating using a specific hopper described in U.S. Pat. No. 2,681,294. In particular, preferable are the extrusion coating and slide coating described together in "Liquid Film Coating" by Stephen F. Kistler and Petert M. Schweizer, published by Chapman and Hall (1997), pages 399 to 536, and the slide coating being more preferable. An exemplary shape of a slide coater used for the slide coating is shown in FIG. 11*b*.1 on page 427 in the above publication. It is also allowable to simultaneously coat two or more layers as required according to the methods described on pages 399 to 536 of the above publication, U.S. Pat. No. 2,761,791 and British Patent No. 837,095.

Techniques applicable to the present invention are also found in European Laid-Open Patent Publication Nos. 803764A1 and 883022A1, WO 98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to 186572, JP-A-10-197974, JP-A-10-197982, JP-A-10-197983, JP-A-10-197985 to 197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201 and JP-A-11-30832, JP-A-11-84574, JP-A-11-65021, JP-A-11-125880, JP-A-11-129629, JP-A-11-133536 to 133539, JP-A-11-133542 and JP-A-11-133543.

While the photothermographic material of the present invention can be developed by any method, the development is generally practiced by elevating the temperature of the photothermographic material after image-wise exposure. Preferable development temperature is 80 to 250° C., and more preferably 100 to 140° C. Development time is preferably 1 to 180 seconds, more preferably 10 to 90 seconds, and still more preferably 10 to 40 seconds.

As for heat development system, the plate heater system is preferable. Heat development based on the plate heater system is preferably performed using an apparatus disclosed in JP-A-11-133572, by which a visible image is obtained by bringing a photothermographic material having a latent image formed therein into contact with a heating means at a heat-developing section. The heating means comprises a plate heater, and a plurality of pressure rollers being opposingly placed along one plane of the plate heater, thereby to allow the photothermographic material to pass between the pressure rollers and plate heater to be heat-developed. It is preferable to section the plate heater in two to six stages, and the temperature of the endmost portion of which is set lower by 1 to 10° C. than the other portions. Such technique is disclosed also in JP-A-54-30032, and can successfully discharge the moisture and organic solvent contained in the photothermographic material out of the system, and can prevent deformation of the support of the photothermographic material due to an abrupt heating thereof.

The photosensitive material of the present invention may be light-exposed by any method but the light source for the exposure is preferably a laser light. The laser light for use in the present invention is preferably any one from a gas laser ($Ar^+$, He—Ne), YAG laser, dye laser, semiconductor laser or the like. The semiconductor laser as combined with a second harmonic generation device may also be used. Preferable is a gas or semiconductor laser emitting red to infrared light.

A single-mode laser is available as a laser light, to which a technique disclosed in the paragraph [0140] of JP-A-11-65021 being applicable.

Laser output is preferably 1 mW or above, more preferably 10 mW or above, and still more preferably as high as 40 mW or above. A plurality of laser beams can be superposed. Beam spot diameter can be approx. 30 to 200 $\mu$m as expressed by an $1/e^2$ spot size of a Gaussian beam.

A laser imager equipped with an exposure section and a heat developing section can be typified by Fuji Medical Dry Imager FM-DPL.

The photothermographic material of the present invention preferably forms a black-and-white image based on silver image and is preferably used for photothermographic materials for medical diagnosis, industrial photograph, printing and COM. Obtained black-and-white image can, of course, be used for producing a duplicated image on duplication film MI-Dup manufactured by Fuji Photo Film Co., Ltd. for medical diagnosis, and used for printing as a mask for forming an image on return films DO-175 and PDO-100 manufactured by Fuji Photo Film Co., Ltd. or on an offset printing plate.

EXAMPLES

The present invention will be explained in more detail with reference to the following examples. It is to be understood that the present invention is by no means limited to the specific examples described below.

Example 1

<<Fabrication of PET Support>>

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness after heat setting of 175 $\mu$m.

The film was then longitudinally stretched 3.3 times at 110.C. using rollers different in the peripheral speed and then transversely stretched 4.5 times at 130.C. using a tenter. Subsequently, the film was heat-set at 240.C. for 20 seconds, and then relaxed by 4% in the transverse direction at the same temperature. Thereafter, a portion chucked by the tenter was slit off and the film was knurled at the both edges and then taken up. Thus, a rolled support of 175 μm thick was fabricated.

<<Surface Corona Treatment>>

Using a solid state corona treatment apparatus (6-kVA model, product of Pillar Corporation), both planes of the support were treated at 20 m/min under the room temperature. Referring to read values of current and voltage, it was confirmed that the support was treated at 0.375 kVA·minute/$m^2$. The treatment frequency was 9.6 kHz and the gap clearance between the electrode and dielectric roll was 1.6 mm.

<<Preparation of Undercoated Support>>

(1) Preparation of Coating Liquid for Undercoat Layer

| | |
|---|---|
| Formulation (1) (for undercoat layer on the photosensitive layer side) | |
| PESRESIN A-515GB (30 wt% solution, manufactured by Takamatsu Oil & Fat Co., Ltd.) | 234 g |
| polyethylene glycol monononylphenyl ether (average number of ethylene oxide = 8.5), 10 wt % solution | 21.5 g |
| MP-1000 (polymer micrograin, average grain size = 0.4 μm, manufactured by Soken Chemical & Engineering Co., Ltd.) | 0.91 g |
| distilled water | 744 ml |
| Formulation (2) (for a first layer on the back plane) | |
| butadiene-styrene copolymer latex (solid content = 40 wt %, ratio by weight of butadiene/styrene = 32/68) | 158 g |
| 2,4-dichloro-6-hydroxy-S-triazine sodium salt (8 wt % aqueous solution) | 20 g |
| sodium laurylbenzenesulfonate (1 wt % aqueous solution) | 10 ml |
| distilled water | 854 ml |
| Formulation (3) (for a second layer on the back plane) | |
| $SnO_2$/Sbo (ratio by weight = 9/1, average grain size = 0.038 μm, 17 wt % dispersion) | 84 g |
| gelatin (10% aqueous solution) | 89.2 g |
| METHOLLOSE TC-5 (2 % aqueous solution, Manufactured by Shin-Etsu Chemical Co., Ltd.) | 8.6 g |
| MP-1000 (polymer micrograin, manufactured by Soken Chemical & Engineering Co., Ltd.) | 0.01 g |
| Sodium dodecylbenzenesulfonate (1 wt % aqueous solution) | 10 ml |
| NaOH (1%) | 6 ml |
| PROXEL (manufactured by ICI Corporation) | 1 ml |
| distilled water | 805 ml |

<<Preparation of Undercoated Support>>

Both sides of the biaxially stretched polyethylene terephthalate film of 175 μm thick were individually subjected to the corona discharge treatment, the formulation (1) of the coating liquid for the undercoat layer was then coated using a wire bar in a wet coated amount of 6.6 ml/$m^2$ on one plane (photosensitive layer side) and was allowed to dry at 180° C. for 5 minutes. The formulation (2) of the coating liquid for the undercoat layer was then coated using a wire bar in a wet coated amount of 5.7 ml/$m^2$ on the rear plane (back plane) and was allowed to dry at 180° C. for 5 minutes, and the formulation (3) of the coating liquid for the undercoat layer was further coated thereon using a wire bar in a wet coated amount of 7.7 ml/$m^2$ and was allowed to dry at 180° C. for 6 minutes, thereby to obtain an undercoated support.

<<Preparation of Solid Micrograin Dispersion (a) of Basic Precursor>>

Sixty-four grams of Basic Precursor Compound 11, 28 g of diphenylsulfone, 10 g of DEMOL-N (surfactant manufactured by KAO Corporation), and 220 ml of distilled water were mixed, and the mixture was bead-dispersed using a sand mill (1/4-gallon Sand Grinder Mill, manufactured by AIMEX Corporation), thereby to obtain a solid microgram dispersion (a) of the basic precursor compound with an average grain size of 0.2 μm.

<<preparation of Solid Micrograin Dispersion of Dye>>

To 305 ml of distilled water, added were 9.6 g of the Cyanine Dye Compound 13 and 5.8 g of sodium p-dodecylbenzenesulfonate, and the mixture was then bead-dispersed using a sand mill (1/4-gallon Sand Grinder Mill manufactured by AIMEX Corporation), thereby to obtain a solid microgram dispersion of the dye with an average grain size of 0.2 μm.

<<Preparation of Coating Liquid for Antihalation Layer>>

Seventeen grams of gelatin, 9.6 g of polyacrylamide, 70 g of the above-described solid microgram dispersion (a) of the basic precursor, 56 g of the above-described solid microgram dispersion of the dye, 1.5 g of polymethyl methacrylate micrograin (average grain size=6.5 μm), 0.03 g of benzoisothiazolinone, 2.2 g of sodium polyethylenesulfonate, 0.2 g of Blue Dye Compound 14 and 844 ml of water were mixed to prepare a coating liquid for the antihalation layer.

<<Preparation of Coating Liquid for Protective Layer on the Back Side>>

While keeping the temperature of a vessel at 40° C., 50 g of gelatin, 0.2 g of sodium polystyrenesulfonate, 2.4 g of N,N-ethyl-enebis (vinylsulfoneacetamide), 1 g of sodium t-octylphenoxy-ethoxyethanesulfonate, 30 mg of benzoisothiazolinone, 37 mg of N-perfluorooctylsulfonyl-N-propylalanine potassium salt, 0.15 g of polyethyleneglycolmono(N-perfluorooctylsulfonyl-N-propyl-2-ami-noethyl) ether (average degree of polymerization of ethylene oxide=15), 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio by weight=5/95), 0.6 g of Aerosol OT (American Cyanamide Corporation), liquid paraffin emulsion in an amount of 1.8 g as the liquid paraffin, and 950 ml of water were mixed, thereby to obtain a coating liquid for the protective layer on the back side.

<<Preparation of Silver Halide Emulsion 1>>

To 1,421 ml of water, added were 8.0 ml of an 1 wt % potassium bromide solution, 8.2 ml of an 1 N nitric acid and 20 g of phthalized gelatin, the mixture was kept stirred in a titanium-coated stainless reaction vessel at a constant liquid temperature of 37° C., and was then added with an entire volume of solution "A" obtained by dissolving 37.04 g of silver nitrate in distilled water and diluting it up to 159 ml, by the controlled double jet method at a constant flow rate over 1 minute while keeping pAg at 8.1. Solution "B" obtained by dissolving 32.6 g of potassium bromide in water and diluting it up to 200 ml was also added by the controlled double jet method. After that, 30 ml of a 3.5 wt % aqueous hydrogen peroxide solution was added, and 36 ml of a 3 wt % aqueous solution of benzoimidazole was further added. Solution "A" was further diluted with distilled water to 317.5 ml to obtain solution "A2", and solution "B" was further added with tripotassium hexachloroiridate so as to attain a final concentration thereof of $1\times10^{-4}$ mol/mol Ag and diluted with distilled water up to doubled volume of 400 ml to obtain solution "B2". Again an entire volume of solution "A2" was added to the mixture by the controlled double jet method at a constant flow rate over 10 minute while keeping pAg at 8.1. Solution "B2" was also added by the controlled double jet method. After that, the mixture was added with 5 ml of an 1 wt % aqueous solution of yellow prussiate of potash (potassium ferrocyanide), the pAg of which was raised to 7.5 with silver nitrate, the pH of which was then adjusted to 3.8 with an 1 N sulfuric acid, stopped stirring, subjected to precipitation/desalting/washing processes, added with 3.5 g of deionized gelatin, the pH and pAg of which were adjusted to 6.0 and 8.2, respectively, with an 1 N sodium hydroxide, thereby to obtain a silver halide emulsion.

Grain in the resultant silver halide emulsion was found to be a pure silver bromide grain with an average sphere-equivalent diameter of 0.043 μm and a sphere-equivalent coefficient of variation of 18%. Grain size and so forth were determined based on an average diameter of 1,000 grains under electron microscopic observation. Ratio of [100] plane of such grain was determined as 85% based on the method of Kubelka-Munk.

The above emulsion was kept at 38° C. under stirring, 0.035 g of benzoisothiazolinone (in a form of a 3.5 wt % methanol solution) was added thereto, a solid dispersion of Spectral Sensitizing Dye "A" (aqueous gelatin solution) was added thereto 40 minutes after in an amount of $5\times10^{-3}$ mol/mol Ag, the temperature thereof was raised to 47° C. one minute after, sodium benzenethiosulfonate was added thereto 20 minutes after in an amount of $3\times10^{-5}$ mol/mol Ag, Tellurium Sensitizer "B" was added thereto 2 minutes after in an amount of $5\times10^{-5}$ mol/mol Ag, and was then ripened for 90 minutes. Immediately before completion of the ripening, 5 ml of a 0.5 wt % methanol solution of N,N'-dihydroxy-N"-diethylmelamine was added, temperature of which was lowered to 31° C., and 5 ml of a 3.5 wt % methanol solution of phenoxy ethanol, $7\times10^{-3}$ mol/mol Ag of 5-methyl-2-mercaptobenzimidazole, and $6.4\times10^{-3}$ mol/mol Ag of 1-phenyl-2-heptyl-5-mercapto-1,3,4-triazole were added, thereby to obtain a silver halide emulsion 1.

<<Preparation of Scaly Fatty Acid Silver Salt>>

A sodium behenate solution was first obtained by mixing 87.6 g of behenic acid (Edenor C22-85R, product of Henkel Corporation), 423 ml of distilled water, 49.2 ml of a 5 N aqueous NaOH solution and 120 ml of t-butanol, and then by allowing the mixture to react at 75° C. for one hour under stirring. Independently, 206.2 ml of aqueous solution containing 40.4 g of silver nitrate (pH4.0) was prepared and kept at 10° C. A reaction vessel containing 635 ml of distilled water and 30 ml of t-butanol was kept at 30° C., and an entire volume of the sodium behenate solution and an entire volume of the aqueous silver nitrate solution were added at constant flow rates and over 62 minutes and 10 second, and over 60 minutes, respectively. Herein only the aqueous silver nitrate solution was added in a first 7-minute-and-20-second period after the start of the addition, then the sodium behenate solution was concomitantly added, and only the sodium behenate solution was added in a last 9-minute-and-30 second period after the end of addition of the aqueous silver nitrate solution. The temperature in the reaction vessel was kept at 30° C., and was controlled externally so as to keep the liquid temperature constant. A piping in a feeding system of the sodium behenate solution was heated using a steam trace, where a steam aperture being adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and aqueous silver nitrate solution were symmetrically arranged centered around a stirring axis, the heights of which being adjusted so as to avoid contact to the reaction solution.

After completion of the addition of the sodium behenate solution, the mixture was allowed to stand for 20 minutes under stirring with the temperature thereof unchanged, and then cooled to 25° C. Solid content was separated by suction filtration, and then washed with water until electric conductivity of the filtrate decreased as low as 30 μS/cm. A fatty acid silver salt was thus obtained. The obtained solid content was stored in a form of wet cake without drying.

From electron microscopic photographing, the obtained silver behenate grain was found to be a scaly crystal having average lengths of "a"=0.14 μm, "b"=0.4 μm and "c"=0.6 μm, an average aspect ratio of 5.2, an average sphere-equivalent diameter of 0.52 μm, and a sphere-equivalent coefficient of variation of 15% ("a", "b" and "c" comply with the definition in this specification).

To the wet cake equivalent to dry weight of 100 g, 7.4 g of polyvinyl alcohol (product name; PVA-217) was added, water was further added to adjust a total volume of 385 g, and the mixture was then preliminarily dispersed using a homomixer.

The preliminarily dispersed liquid was dispersed three times using a dispersion apparatus (Micro Fluidizer M-110S-EH, manufactured by Micro Fluidex International Corporation, equipped with G10Z interaction chamber) under a pressure of 1,750 kg/cm$^2$, thereby to obtain a silver behenate dispersion. During the dispersion, cooling operation was effected using coiled heat exchangers attached to the inlet and outlet of the interaction chamber, and the temperature of the coolant was controlled to keep the dispersion temperature at 18° C.

<<Preparation of 25 wt % Dispersion of Reducing Agent>>

Ten kilograms of 1,1-bis(2-hydroxy-3,5-dimethylphenyl)-3,5,5-trimethylhexane and 10 kg of a 20 wt % aqueous solution of a modified polyvinylalcohol (Poval MP-203, manufactured by Kuraray Co., Ltd.) were added with 16 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 3 hours and 30 minutes, added with 0.2 g of benzoisothiazolinone sodium salt and water so as to adjust the concentration of the reducing agent to 25 wt %, thereby to obtain a dispersion of the reducing agent. Reducing agent grain contained in thus obtained dispersion was found to have a median diameter of 0.42 μm and a maximum diameter of 2.0 μm or less. The obtained reducing agent dispersion was filtered through a polypropylene filter with a pore size of 10.0 μm to separate dust or other foreign matters and then stored.

<<Preparation of 20 wt % Dispersion-1 of Organic Polyhalogen Compound>>

Five kilograms of tribromomethylnaphthylsulfone, 2.5 kg of a 20 wt % aqueous solution of a modified polyvinylalcohol (Poval MP-203, manufactured by Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 5 hours, added with 0.2 g of benzoisothiazolinone sodium salt and water so as to adjust the concentration of the organic polyhalogen compound to 20 wt %, thereby to obtain a dispersion of the organic polyhalogen compound. Organic polyhalogen compound grain contained in thus obtained dispersion was found to have a median diameter of 0.36 μm and a maximum diameter of 2.0 μm or less. The obtained organic polyhalogen compound dispersion was filtered through a polypropylene filter with a pore size of 3.0 μm to separate dust or other foreign matters and then stored.

<<Preparation of 25 wt % Dispersion-2 of Organic Polyhalogen Compound>>

Dispersion was performed similarly to the case with the 20 wt % dispersion-1 of the organic polyhalogen compound, except that using 5 kg of tribromomethyl[4-(2,4,6-trimethylphenylsulfonyl)phenyl]-sulfone in place of 5 kg of tribromomethylnaphthylsulfone, the dispersion was then diluted so as to adjust the concentration of the organic polyhalogen compound to 25 wt % and filtered. Organic polyhalogen compound grain contained in thus obtained dispersion was found to have a median diameter of 0.38 μm and a maximum diameter of 2.0 μm or less. The obtained organic polyhalogen compound dispersion was filtered through a polypropylene filter with a pore size of 3.0 μm to separate dust or other foreign matters and then stored.

<<Preparation of 30 wt % Dispersion-3 of Organic Polyhalogen Compound>>

Dispersion was performed similarly to the case with the 20 wt % dispersion-1 of the organic polyhalogen compound except that using 5 kg of tribromomethylphenylsulfone in place of 5 kg of tribromo-methylnaphthylsulfone and that increasing the amount of use of the 20 wt % aqueous solution of MP-203 to 5 kg, the dispersion was then diluted so as to adjust the concentration of the organic polyhalogen compound to 30 wt % and filtered. Organic polyhalogen compound grain contained in thus obtained dispersion was found to have a median diameter of 0.41 μm and a maximum diameter of 2.0 μm or less. The obtained organic polyhalogen compound dispersion was filtered through a polypropylene filter with a pore size of 3.0 μm to separate dust or other foreign matters and then stored. The dispersion was stored at 10° C. until it is used.

<<Preparation of 5 wt % Solution of Phthalazine Compound>>

Eight kilograms of modified polyvinyl alcohol MP-203 (product of Kuraray Co., Ltd.) was dissolved in 174.57 kg of water, and 3.15 kg of a 20 wt % aqueous solution of sodium triisopropyl-naphthalenesulfonate and 14.28 kg of a 70 wt % aqueous solution of 6-isopropylphthalazine were added, thereby to prepare a 5 wt % solution of 6-isopropylphthalazine.

<<Preparation of 20 wt % Dispersion of Pigment>>

Sixty-four grams of C.I. Pigment Blue 60 and 6.4 g of DEMOL-N (manufactured by Kao Corporation) were added with 250 g of water, and then mixed thoroughly to prepare a slurry. The slurry was then fed into a vessel of a dispersion apparatus (1/4G Sand Grinder Mill manufacture by Aimex, Ltd.) together with 800 g of zirconia bead with an average diameter of 0.5 mm, and dispersed for 25 hours to obtain a pigment dispersion. Pigment grain contained in thus obtained dispersion was found to have an average diameter of 0.21 μm.

<<Preparation of 40 wt % Solution of SBR Latex>>

SBR latex purified by ultrafiltration (UF) was obtained as follows:

A ten-fold dilution of SBR latex in distilled water was diluted and purified using an UF-purification module FS03-FC-FUYO3A1 (manufactured by Daicen Membrane-Systems, Ltd.) until the ion conductivity is reduced as low as 1.5 mS/cm, Sandet-BL (manufactured by Sanyo Chemical Industries) was then added so as to attain a concentration of 0.22 wt %, and NaOH and $NH_4OH$ were further added so as to attain a molar ratio of $Na^+$:$NH_4$=1:2.3 and a pH of 8.4. The resultant latex concentration was found to be 40 wt %. Specification of the latex is as follows:

SBR latex: —St(68)—Bu(29)—AA(3)— average grain size=0.1 μm, concentration=45%, equilibrium water content at 25° C., 60% RH=0.6 wt %, ion conductivity=4.2 mS/cm (measured for latex solution (40%) at 25° C. using a conductometer CM-30S manufactured by TOA Electronics Ltd.), pH 8.2

<<Preparation of Coating Liquid for Emulsion Layer (Photosensitive Layer>>

Mixed were 1.1 g of the above-obtained 20 wt % dispersion of the pigment, 103 g of the fatty acid silver salt dispersion, 5 g of a 20 wt % aqueous solution of polyvinyl alcohol PVA-205 (manufactured by Kuraray Co., Ltd.), 25 g of the above-obtained 25 wt % dispersion of the reducing agent, total 16.3 g of 5:1:3 mixture (ratio by weight) of the dispersions-1, -2 and -3 of the organic polyhalogen compounds, 106 g of the 40 wt % solution of SBR latex purified by ultrafiltration (UF) and 18 ml of the 5 wt % solution of the phthalazine compound, and 1 ml of a 0.1 wt % aqueous solution of the Compound I-(11), and the mixture was then thoroughly stirred. The silver halide emulsion 1 was then added so as to attain the silver halide content per mol of fatty acid silver salt of 0.1 mol, and then thoroughly mixed to prepare a coating liquid for the emulsion layer, which was then directly fed to a coating die and coated so as to attain a coated silver amount of 1.5 g/$m^2$.

Viscosity of the coating liquid for the emulsion layer was measured using a B-type viscometer (manufactured by Tokyo Keiki K.K.) at 40° C., (with No. 1 rotor at 60 rpm) and was found to be 85 mPa·s.

Viscosities of the coating liquid measured under shearing velocities of 0.1, 1, 10, 100 and 1,000 (1/second) at 25° C. using RFS Fluid Spectrometer (manufactured by Rheometrix Far East Inc.) were 1,500, 220, 70, 40 and 20 mPa·s, respectively.

<<Preparation of Coating Liquid for Intermediate Layer in the Emulsion Layer Side>>

A coating liquid for the intermediate layer was prepared by mixing 772 g of a 10 wt % aqueous solution of polyvinyl alcohol PVA-205 (manufactured by Kuraray Co., Ltd.), 5.3 g of the 20 wt % dispersion of the pigment, 226 g of a 27.5 wt % solution of methyl methacrylate/styrene/butyl acrylate/hydroxyethyl methacrylate/acrylic acid copolymer latex (copolymerization ratio by weight of 64/9/20/5/2), 2 ml of a 5 wt % aqueous solution of Aerosol 0T (American Cyanamide Corporation), and 10.5 ml of a 20 wt % aqueous solution of diammonium phthalate, and by adjusting the total weight to 880 g by adding water. The obtained coating liquid was then fed to a coating die so as to attain a coating amount of 10 ml/$m^2$.

Viscosity of the coating liquid measured at 40° C. using a B-type viscometer (with No. 1 rotor at 60 rpm) was found to be 21 mPa·s.

<<Preparation of Coating Liquid for First Protective Layer in the Emulsion Layer Side>>

Sixty-four grams of inert gelatin was dissolved in water, and added thereto were 80 g of a 27.5 wt % solution of methyl methacrylate/styrene/butyl acrylate/hydroxyethyl methacrylate/acrylic acid copolymer latex (copolymerization ratio by weight of 64/9/20/5/2), 23 ml of a 10 wt % methanol solution of phthalic acid, 23 ml of a 10 wt % aqueous solution of 4-methylphthalic acid, 28 ml of an 1 N sulfuric acid, 5 ml of a 5 wt % aqueous solution of Aerosol 0T (American Cyanamide Corporation), 0.5 g of phenoxyethanol and 0.1 g of benzoisothiazolinone, then the total weight was adjusted to 750 g by adding water to prepare a coating liquid. The coating liquid was added with 26 ml of a 4 wt % chrome alum solution using a static mixer immediately before the coating and fed to a coating die so as to attain a coating amount of 18.6 ml/$m^2$.

Viscosity of the coating liquid measured at 40° C. using a B-type viscometer (with No. 1 rotor at 60 rpm) was found to be 17 mPa·s.

<<Preparation of Coating Liquid for Second Protective Layer in the Emulsion Layer Side>>

Eighty grams of inert gelatin was dissolved in water, and added thereto were 102 g of a 27.5 wt % solution of methyl methacrylate/styrene/butyl acrylate/hydroxyethyl methacrylate/acrylic acid copolymer latex (copolymerization ratio by weight of 64/9/20/5/2), 3.2 ml of a 5 wt % solution of N-perfluorooctylsulfonyl-N-propylalanine potassium salt, 32 ml of a 2 wt % aqueous solution of polyethylene-glycolmono (N-perfluorooctylsulfonyl-N-propyl-2-aminoethyl)ether [average degree of polymerization of ethylene oxide=15 ], 23 ml of a 5 wt % aqueous solution of Aerosol 0T (American Cyanamide Corporation), 4 g of polymethylmethacrylate microgram (average grain size=0.7 $\mu$m), 21 g of polymethylmethacrylate microgram (average grain size=6.4 $\mu$m), 1.6 g of 4-methylphthalic acid, 4.8 g of phthalic acid, 44 ml of an 1 N sulfuric acid, 10 mg of benzoisothiazolinone, then the total weight was adjusted to 650 g by adding water. The mixture was added with 445 ml of an aqueous solution containing 4 wt % chrome alum and 0.67% of phthalic acid using a static mixer immediately before the coating, which was fed to a coating die so as to attain a coating amount of 8.3 ml/$m^2$.

Viscosity of the coating liquid measured at 40° C. using a B-type viscometer (with No. 1 rotor at 60 rpm) was found to be 9 mPa·s.

<<Fabrication of Photothermographic Material>>

On the back side of the undercoated support, the coating liquid for the antihalation layer and the coating liquid for the back side protective layer were simultaneously formed by coating in a stacked manner, so as to attain a coated amount of 0.04 g/$m^2$ in terms of solid content of the solid microgram dye for the former, and 1.7 g/$m^2$ in terms of gelatin for the latter, respectively. The coated films were then dried to obtain a halation-preventive back layer.

On the opposite side of the back side and on the undercoat layer, an emulsion layer (in a coated amount of 0.14 g/$m^2$ as silver in the silver halide), an intermediate layer, a first protective layer and a second protective layer were formed in this order by the simultaneous multi-layer coating based on the slide bead system, thereby to obtain a sample of the photothermographic material.

The coating was effected at a speed of 160 m/min while keeping a gap between the end of the coating die and the support at 0.14 to 0.28 mm, and adjusting so that coating width becomes wider than the width of the slit for ejecting the coating liquid by 0.5 mm each from the both edges, and keeping a pressure in a reduced pressure chamber lower by 392 Pa than the atmospheric pressure. Care was taken for the handling and controlling temperature and humidity so as to prevent electric charging of the support, and the support was further blown with ion wind immediately before the coating. Next, the coated liquid was cooled in a chilling zone by blowing wind with a dry-bulb temperature of 18° C. and a wet-bulb temperature of 12° C. for 30 seconds, further dried in a helical floating drying zone by blowing wind with a dry-bulb temperature of 30° C. and a wet-bulb temperature of 18° C. for 200 seconds, still further dried while being passed in a drying zone at 70° C. for 20 seconds and then in a drying zone at 90° C. for 10 seconds, then cooled to 25° C. to vaporize the solvent in the coated liquid. An average velocity of the wind blown onto the surface of the coated liquid in the chilling zone and drying zone was 7 m/s.

The degree of matting expressed as Bekk smoothness of thus-obtained photothermographic material was found to be 550 seconds for the photosensitive layer side, and 130 seconds for the back side.

Thus Sample 8 of the black and white photothermographic material as listed in Table 1 was obtained.

Spectral Sensitizing dye "A"

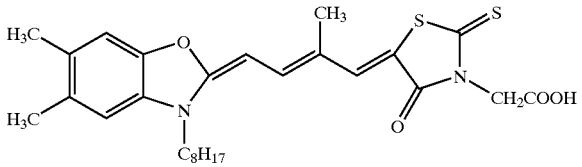

Tellurium Sensitizer "B"

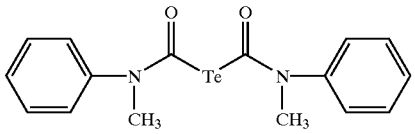

Basic Precursor Compound 11

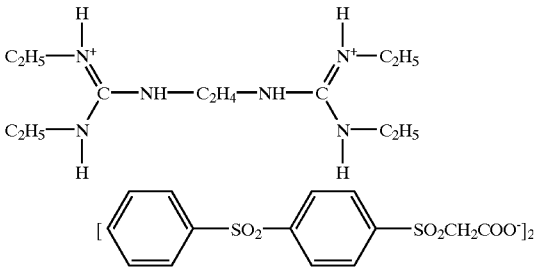

Cyanine Dye Compound 13

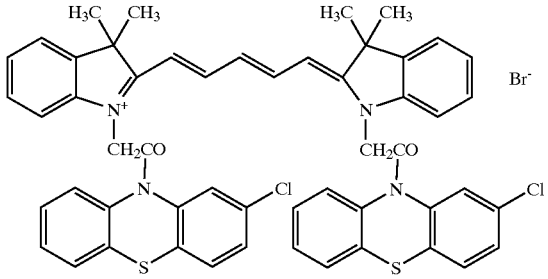

Blue Dye Compound 14

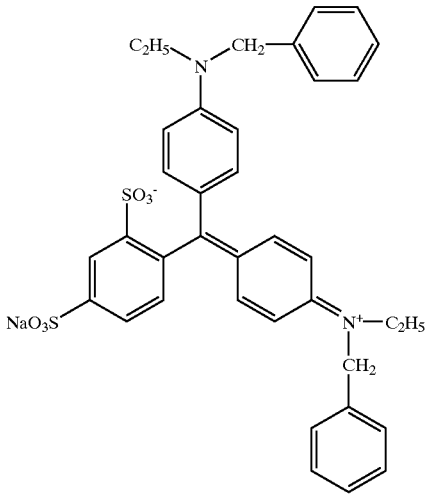

Example 2

<<Preparation of Silver Halide Emulsions 2, 3, 4 and 5>>

In the preparation of the silver halide emulsion 1, the liquid temperature and amount of addition of yellow prussiate of potash (potassium ferrocyanide) during the grain formation were altered to obtain the silver halide grains having the grain sizes as listed in Table 1. Samples 6, 7, 9 and 10 as shown in Table 1 were then prepared similarly to Example 1 except that the amount of addition of the sensitizing Dye "A" was altered in accordance with the surface area of the silver halide grains, and that the amount of addition of Tellurium Senzitizer "B" was altered so as to attain an optimum sensitivity. Samples 1 to 5 (Comparative Samples) were also prepared similarly to Samples 6 to 10 except that compound I-(11) used in the present invention was not added.

Example 3

Photosensitive materials obtained in Examples 1 and 2 were evaluated as follows:

<Evaluation of Maximum Optical Density Dmax>

The Samples were exposed and heat-developed (at approx. 120° C.) with Fuji Medical Dry Laser Imager FM-DPL [equipped with a 660-nm semiconductor laser device, maximum output=60 mW (IIIB)]), and obtained images were evaluated using a densitometer. Optical density observed at the site of a maximum exposure energy was assumed as a maximum optical density Dmax.

<Evaluation of Desensitization During Storage>

Samples were conditioned at 25° C. and under a relative humidity of 40% for 20 hours, then divided into two groups and enclosed tightly in two moisture-proof bags. One groups of the samples were stored in a room at 40° C. for 30 days, and the other groups of the samples were stored in a room at 10° C. for 30 days. Two groups of the samples thus treated were individually exposed and heat-developed using Fuji Medical Dry Laser Imager similarly to the case for evaluating Dmax, and an inverse of a laser energy affording (fog +optical density 1.0) was defined as sensitivity. Desensitization in percent, that is, a ratio in percent of the desensitization was defined as a value obtained by dividing sensitivity for the samples stored in the room at 40° C. by sensitivity for the samples stored in the room at 10° C.

Results of the evaluation for respective Samples 1 to 10 were summarized in Table 1.

TABLE 1

| Sample No. | Grain size of silver halide (nm) | Mercapto compound | Desensitization during storage (%) | Dmax | Remarks |
|---|---|---|---|---|---|
| 1 | 28 | — | 10 | 4.2 | comparison |
| 2 | 36 | — | 10 | 3.9 | comparison |
| 3 | 43 | — | 40 | 3.7 | comparison |
| 4 | 47 | — | 70 | 3.6 | comparison |
| 5 | 60 | — | 90 | 3.4 | comparison |
| 6 | 28 | I-(11) | 75 | 4.2 | invention |
| 7 | 36 | I-(11) | 80 | 3.9 | invention |
| 8 | 43 | I-(11) | 80 | 3.7 | invention |
| 9 | 47 | I-(11) | 85 | 3.6 | invention |
| 10 | 60 | I-(11) | 92 | 3.4 | comparison |

As is clear from Table 1, each of Samples 6, 7, 8 and 9 according to the present invention was proven to be preferable since Dmax thereof is high enough and the desensitization during the storage was successfully suppressed to a degree causing no problem on a practical base. This indicates that the mercapto compound used in the present invention can exhibit a significant effect in improving the desensitization during the storage even when the grain size of the silver halide is in a small range likely to cause the desensitization.

Example 4

Samples 11 to 17 were fabricated similarly to Example 1 except that fixing the grain size of the silver halide and using compounds listed in Table 2 in place of Compound I-(11). Results of Dmax and the desensitization, evaluated similarly to those in Example 3, were summarized in Table 2. Chemical structures of Comparative compounds 1 to 3 used for preparing Comparative Samples 15 to 17 are liseted below:

Comparative Compound 1

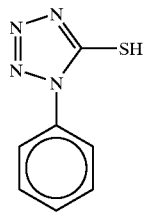

Comparative Compound 2

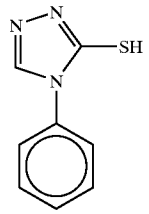

Comparative Compound 3

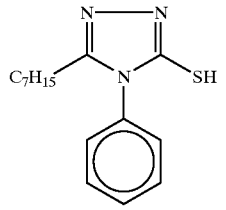

TABLE 2

| Sample No. | Grain size of silver halide (nm) | Mercapto compound | Desensitization during storage (%) | Dmax | Remarks |
|---|---|---|---|---|---|
| 11 | 36 | I-(10) | 80 | 3.9 | invention |
| 12 | 36 | I-(14) | 70 | 3.9 | invention |
| 13 | 36 | I-(15) | 65 | 3.9 | invention |
| 14 | 36 | I-(17) | 65 | 3.9 | invention |
| 15 | 36 | Comparative Compound 1 | 10 | 3.9 | comparison |
| 16 | 36 | Comparative Compound 2 | 15 | 3.9 | comparison |
| 17 | 36 | Comparative Compound 3 | 6 | 3.95 | comparison |

As is clear from Table 2, the photosensitive materials using the compound expressed by the formula (1) according to the present invention were significantly improved in the desensitization during storage.

What is claimed is:

1. A method for fabricating a black and white photothermographic material containing on one side of a support a reducing agent for reducing silver ion, a binder, a non-photosensitive fatty acid silver salt and a photosensitive silver halide, comprising:

a step for preliminarily making a compound expressed by the formula (1) below adsorb to grains of the non-photosensitive fatty acid silver salt:

$$[(Z)_mL]_nASM^1 \qquad \text{formula (1)}$$

where, in the formula (1), Z represents $—SO_3M^2$, $—COOR^1$, —OH or $—NHR^2$; in which $M^2$ being a hydrogen atom or an alkali metal atom, $R^1$ being a hydrogen atom, an alkali metal atom or an alkyl group having 1 to 6 carbon atoms, $R^2$ being a hydrogen atom, an alkyl group having 1 to 6 carbon atoms, $—COR^4$, $—COOR^4$ or $—SO_2R^4$, in which $R^4$ being a hydrogen atom, an aliphatic group or an aromatic group;

m is an integer not less than 1, and for the case of $m \geqq 2$, the groups Z in a number of m may be same or different with each other;

L represents a single bond or a linkage group;

n is an integer not less than 1, and for the case of $n \geqq 2$, the groups $(Z)_mL$ in a number of n may be same or different with each other;

A is a heterocyclic group which may be substituted; and $M^1$ is a hydrogen atom or an alkali metal atom;

a step for preparing the photosensitive silver halide grains having an average grain size of 10 nm to 50 nm; and a step for mixing the non-photosensitive fatty acid silver salt grains having the compound expressed by the formula (1) adsorbed thereon with the photosensitive silver halide grains.

2. The method of claim 1, wherein the compound expressed by the formula (1) is contained as being adsorbed on the non-photosensitive fatty acid silver salt.

3. The method of claim 1, wherein the average grain size of the photosensitive silver halide is 10 nm to 45 nm.

4. The method of claim 1, wherein the average grain size of the photosensitive silver halide is 10 nm to 40 nm.

5. The method of claim 1, wherein the compound expressed by the formula (1) is contained in an amount of $1\times10^{-5}$ to $1\times10^{-2}$ mol per mole of fatty acid silver salt.

6. The method of claim 1, wherein the compound expressed by the formula (1) is contained in an amount of $1\times10^{-4}$ to $5\times10^{-3}$ mol per mole of fatty acid silver salt.

7. The method of claim 1, wherein Z in the formula (1) is $—SO_3M^2$.

8. The method of claim 7, wherein $M^2$ is Na.

9. The method of claim 1, wherein m in the formula (1) is 1, 2 or 3.

10. The method of claim 1, wherein m in the formula (1) is 1 or 2.

11. The method of claim 1, wherein L in the formula (1) is alkylene having 1–6 carbon atoms; arylene group; —O—; —S—; —NR—, wherein R is represented by a fatty acid group or aromatic group; $—SCH_2—$, $—SCH_2CH_2—$; $—SCH(n—C_4H_9)—$; $—SCH_2CH_2N(CH_2)_2—$; $—SCH(n—C_3H_7)—$; $—OCH_2—$; and combinations thereof.

12. The method of claim 1, wherein n in the formula (1) is 1, 2 or 3.

13. The method of claim 12, wherein n in the formula (1) is 1 or 2.

14. The method of claim 1, wherein A in the formula (1) is benzoimidazole, naphthimidazole, benzothiazole, naphththiazole, benzoxazole, naphthoxazole, benzoselenazole, benzotellurazole, imidazole, imidazoline, oxazole, oxadiazole, pyrazole, triazole, thiadiazole, tetrazole, triazine, pyrimidine, pyridazine, pyrazine, pyridine, purine, quinoline or quinazolinone.

* * * * *